US011459962B2

(12) United States Patent
Sudarsan

(10) Patent No.: US 11,459,962 B2
(45) Date of Patent: Oct. 4, 2022

(54) ELECTRONIC VALVE CONTROL

(71) Applicant: SparkCognition, Inc., Austin, TX (US)

(72) Inventor: Sridhar Sudarsan, Austin, TX (US)

(73) Assignee: SPARKCOGNITTON, INC., Austin, TX (US)

( * ) Notice: Subject to any disclaimer, the term of this patent is extended or adjusted under 35 U.S.C. 154(b) by 0 days.

(21) Appl. No.: 17/183,671

(22) Filed: Feb. 24, 2021

(65) Prior Publication Data

US 2021/0348576 A1 Nov. 11, 2021

Related U.S. Application Data

(60) Provisional application No. 62/984,029, filed on Mar. 2, 2020.

(51) Int. Cl.

| | |
|---|---|
| ***F02D 13/02*** | (2006.01) |
| ***F02D 41/14*** | (2006.01) |
| ***F02D 41/24*** | (2006.01) |

(52) U.S. Cl.

CPC ..... *F02D 13/0253* (2013.01); *F02D 13/0203* (2013.01); *F02D 41/1406* (2013.01); *F02D 41/2445* (2013.01); *F02D 2041/1433* (2013.01); *F02D 2200/501* (2013.01); *F02D 2200/606* (2013.01); *F02D 2200/701* (2013.01); *F02D 2200/702* (2013.01)

(58) Field of Classification Search

CPC ..... F02D 13/0253

See application file for complete search history.

(56) References Cited

U.S. PATENT DOCUMENTS 5,200,898 A * 4/1993 Yuhara ..... F02D 41/045 123/480
5,247,445 A * 9/1993 Miyano ..... F02D 41/2467 123/674
5,361,213 A * 11/1994 Fujieda ..... F02D 41/1405 123/436
5,495,415 A * 2/1996 Ribbens ..... G01M 15/11 123/436
5,657,737 A * 8/1997 Ishida ..... G05B 13/027 123/690

(Continued)

FOREIGN PATENT DOCUMENTS

CN 104656443 A * 5/2015 ..... F02D 37/02
CN 104656443 B * 5/2017 ..... F02D 37/02

(Continued)

OTHER PUBLICATIONS

International Search Report and Written Opinion for Application No. PCT/US2021/019763 dated May 7, 2021, 11 pages.

*Primary Examiner* — Kevin R Steckbauer
(74) *Attorney, Agent, or Firm* — Moore IP Law

(57) ABSTRACT

A method of controlling an electronically controllable valve of an engine includes receiving, from one or more operation sensors, operation data including sensor data corresponding to a condition of the engine, control inputs indicative of operation of equipment that includes the engine, or a combination thereof. The method includes determining, using a trained valve control model, an operating characteristic of the valve at least partially based on the operation data, and generating a control signal to effect operation of the valve in accordance with the operating characteristic.

22 Claims, 9 Drawing Sheets

(56) References Cited

U.S. PATENT DOCUMENTS 6,032,139 A * 2/2000 Yamaguchi ..... F02D 41/1401 700/48
6,064,996 A * 5/2000 Yamaguchi ..... F02D 41/1401 706/20
6,088,647 A * 7/2000 Hemberger ..... F02D 41/401 701/104
6,092,018 A * 7/2000 Puskorius ..... F02D 31/005 123/339.11
6,236,908 B1 * 5/2001 Cheng ..... F02D 41/0062 701/1
6,304,862 B1 * 10/2001 Yamaguchi ..... G05B 13/027 706/14
6,306,063 B1 * 10/2001 Horgan ..... B60K 31/047 340/439
6,324,529 B1 * 11/2001 Kamihira ..... G06N 3/086 706/13
6,324,530 B1 * 11/2001 Yamaguchi ..... F02D 41/1401 706/13
6,397,113 B1 * 5/2002 Kamihira ..... G05B 13/0265 700/47
6,405,122 B1 * 6/2002 Yamaguchi ..... F02D 41/1405 706/31
6,619,245 B1 * 9/2003 Fujiwara ..... F02D 13/0253 123/90.11
6,971,345 B2 * 12/2005 Nareid ..... F02D 41/0002 123/90.11
6,997,146 B2 * 2/2006 Yoeda ..... F02D 41/20 123/90.11
7,073,493 B2 * 7/2006 Nakasaka ..... F02D 13/0261 123/305
7,159,547 B2 * 1/2007 Nakasaka ..... F02D 41/1405 123/691
7,398,772 B2 * 7/2008 Nakasaka ..... F01L 13/0036 123/90.15
7,487,031 B2 * 2/2009 Yasui ..... F02D 41/1401 123/347
7,690,350 B2 * 4/2010 Delp ..... F02D 41/18 123/90.15
7,765,795 B2 * 8/2010 Driscoll ..... F02D 41/146 60/287
7,900,509 B2 * 3/2011 Feldkamp ..... F02D 13/06 73/114.79
8,155,857 B2 * 4/2012 Loeffler ..... F02D 41/1402 701/111
9,593,631 B2 * 3/2017 Batal ..... F02D 41/28
9,915,217 B2 * 3/2018 Bizub ..... F02D 35/027
10,013,658 B2 * 7/2018 Streichert ..... G06N 20/00
10,018,127 B2 * 7/2018 Hoffmeyer ..... F02D 41/0002
10,030,602 B2 * 7/2018 Vaughan ..... F02D 41/263
10,054,043 B2 * 8/2018 Matthews ..... F01L 1/34403
10,132,260 B2 * 11/2018 Meldrum ..... F02D 41/0007
10,530,290 B2 * 1/2020 Janik ..... G06Q 10/06312
10,533,510 B2 * 1/2020 Gotter ..... F02D 41/1405
10,563,545 B2 * 2/2020 Zhang ..... F02D 41/2409
10,634,081 B2 * 4/2020 Kitagawa ..... G06N 3/084
10,788,396 B2 * 9/2020 Attard ..... G01M 15/04
10,794,310 B2 * 10/2020 Ge ..... F02D 41/1462
10,816,438 B2 * 10/2020 Chen ..... F02D 41/0087
10,825,267 B2 * 11/2020 Kitagawa ..... G05B 13/027
10,830,187 B1 * 11/2020 Muto ..... F02M 25/0872
10,853,727 B2 * 12/2020 Kitagawa ..... G05B 13/024
10,876,500 B2 * 12/2020 Kitagawa ..... F02M 26/09
10,947,919 B1 * 3/2021 Charbonnel ..... F02D 41/0085
10,961,936 B2 * 3/2021 Muto ..... G06N 3/08
10,969,304 B2 * 4/2021 Hashimoto ..... F02D 41/1498
10,991,174 B2 * 4/2021 Takasu ..... G07C 5/0808
11,008,965 B2 * 5/2021 Muto ..... F02D 41/1405
11,053,880 B1 * 7/2021 Yamada ..... F02D 13/0219
11,125,175 B2 * 9/2021 Chen ..... G06N 20/00
11,125,202 B1 * 9/2021 Xu ..... F02P 5/045
11,143,575 B2 * 10/2021 Chen ..... F02D 17/02
11,174,777 B2 * 11/2021 Muto ..... F01P 11/16
11,230,985 B2 * 1/2022 Nakamura ..... F02D 41/1405
11,242,814 B2 * 2/2022 Muto ..... F02D 41/22
11,326,541 B2 * 5/2022 Hashimoto ..... G06N 3/08
2002/0104520 A1 * 8/2002 Nakasaka ..... F01L 1/053 123/673
2003/0167095 A1 * 9/2003 Nareid ..... F01L 9/10 700/67
2003/0217714 A1 * 11/2003 Yoeda ..... F02D 41/20 123/90.11
2004/0231650 A1 * 11/2004 Gray, Jr. ..... F02D 41/0007 123/568.12
2006/0207582 A1 * 9/2006 Nakasaka ..... F02D 41/1405 123/90.15
2007/0074705 A1 * 4/2007 Nakasaka ..... F01L 13/0042 123/90.15
2007/0203616 A1 * 8/2007 Borrmann ..... G06N 3/0481 701/1
2007/0251218 A1 * 11/2007 Driscoll ..... F02D 41/40 60/301
2008/0091332 A1 * 4/2008 Yasui ..... F02D 41/0002 701/102
2009/0178644 A1 * 7/2009 Delp ..... F02D 41/18 123/90.15
2009/0259385 A1 * 10/2009 Loeffler ..... F02D 35/023 701/102
2009/0312926 A1 * 12/2009 MacFarlane ..... B60W 10/06 701/59
2009/0319160 A1 * 12/2009 Callahan ..... F02D 9/04 701/111
2010/0031738 A1 * 2/2010 Feldkamp ..... G01M 15/042 73/114.79
2011/0093182 A1 * 4/2011 Weber ..... F02D 41/1448 73/114.25
2013/0110749 A1 * 5/2013 Streichert ..... F02D 41/1401 706/12
2013/0184967 A1 * 7/2013 Kang ..... F02D 41/3035 701/102
2014/0283764 A1 * 9/2014 Abou-Nasr ..... F01P 7/162 123/41.47
2015/0134230 A1 * 5/2015 Hoffmeyer ..... F02D 41/0007 701/103
2016/0025028 A1 * 1/2016 Vaughan ..... F02D 41/1405 701/115
2016/0258378 A1 * 9/2016 Bizub ..... G01L 23/221
2016/0281617 A1 * 9/2016 Batal ..... F02D 35/027
2016/0298537 A1 * 10/2016 Matthews ..... F02D 41/2464
2016/0341140 A1 * 11/2016 Gotter ..... F02D 13/0207
2017/0080931 A1 * 3/2017 D'Amato ..... B60W 30/18072
2017/0248093 A1 * 8/2017 Meldrum ..... F02D 41/18
2017/0302218 A1 * 10/2017 Janik ..... B63B 21/50
2019/0017487 A1 * 1/2019 Rudnitzki ..... F02D 41/009
2019/0128233 A1 * 5/2019 Zhao ..... F02B 75/02
2019/0145859 A1 * 5/2019 Chen ..... G06N 3/0481 701/102
2019/0195173 A1 * 6/2019 Kitagawa ..... F02D 41/1405
2019/0242318 A1 * 8/2019 Kitagawa ..... G06N 3/084
2019/0316496 A1 * 10/2019 Zhang ..... F02D 41/009
2019/0325671 A1 * 10/2019 Takasu ..... G06N 3/04
2020/0040829 A1 * 2/2020 Braun ..... F02D 41/009
2020/0109678 A1 * 4/2020 Nakamura ..... G06N 3/0481
2020/0116094 A1 * 4/2020 Ge ..... F02D 41/2429
2020/0143607 A1 * 5/2020 Kitagawa ..... F02D 41/2451
2020/0200140 A1 * 6/2020 Attard ..... F02D 41/1405
2020/0234136 A1 * 7/2020 Kitagawa ..... G05B 23/0254
2020/0248641 A1 * 8/2020 Nakamura ..... F02D 41/1405
2020/0263617 A1 * 8/2020 Hashimoto ..... F02D 41/22
2020/0264074 A1 * 8/2020 Hashimoto ..... G01M 15/11
2020/0300156 A1 * 9/2020 Muto ..... F01P 7/167
2020/0332747 A1 * 10/2020 Muto ..... F02M 25/0854
2020/0378329 A1 * 12/2020 Muto ..... F02D 41/22
2020/0378330 A1 * 12/2020 Muto ..... F02M 26/13
2020/0392915 A1 * 12/2020 Muto ..... F02D 41/3845
2021/0003088 A1 * 1/2021 Chen ..... F02D 41/0087
2021/0053577 A1 * 2/2021 Hashimoto ..... F02D 41/1405
2021/0053578 A1 * 2/2021 Hashimoto ..... F02D 41/1497
2021/0054800 A1 * 2/2021 Hashimoto ..... F02D 41/009
2021/0062744 A1 * 3/2021 Charbonnel ..... F02D 41/401
2021/0062747 A1 * 3/2021 Hashimoto ..... F02D 35/023

(56) References Cited

U.S. PATENT DOCUMENTS

| | | | | |
|---|---|---|---|---|
| 2021/0102510 | A1* | 4/2021 | Tanaka | G06N 3/084 |
| 2021/0115834 | A1* | 4/2021 | Hashimoto | F01N 11/005 |
| 2021/0172344 | A1* | 6/2021 | Juchymenko | F01K 23/101 |
| 2021/0207553 | A1* | 7/2021 | Yamada | F02D 41/18 |
| 2021/0222662 | A1* | 7/2021 | Do | F02P 5/1502 |
| 2021/0254571 | A1* | 8/2021 | Hashimoto | B60W 50/0098 |
| 2021/0262896 | A1* | 8/2021 | Chen | F02D 41/1448 |
| 2021/0348576 | A1* | 11/2021 | Sudarsan | F02D 13/0203 |
| 2021/0355884 | A1* | 11/2021 | Chae | F02N 11/0814 |
| 2021/0404912 | A1* | 12/2021 | Chen | G01M 15/102 |
| 2022/0010744 | A1* | 1/2022 | Chen | F01N 13/10 |

FOREIGN PATENT DOCUMENTS

| | | | | | |
|---|---|---|---|---|---|
| CN | 107472038 | A | * | 12/2017 | B60L 50/15 |
| CN | 110259590 | A | * | 9/2019 | F02D 37/02 |
| CN | 110552804 | A | * | 12/2019 | F02D 41/1405 |
| CN | 107472038 | B | * | 5/2020 | B60L 50/15 |
| CN | 112031962 | A | * | 12/2020 | F02D 41/0052 |
| CN | 112963256 | A | * | 6/2021 | |
| CN | 113153551 | A | * | 7/2021 | F02D 13/0215 |
| DE | 112009005032 | T5 | * | 8/2012 | F02D 11/10 |
| DE | 112009005032 | B4 | * | 5/2017 | F02D 11/10 |
| DE | 102020109988 | A1 | * | 12/2020 | F02D 41/0052 |
| JP | 09100737 | A | * | 4/1997 | F02D 41/083 |
| JP | WO2011001529 | A1 | * | 1/2011 | F02D 11/10 |
| JP | 5560275 | B2 | * | 7/2014 | F02D 11/10 |
| JP | 6725087 | B1 | * | 7/2020 | F01M 13/00 |
| JP | 6750708 | B1 | * | 9/2020 | F02D 41/0052 |
| JP | 2020197165 | A | * | 12/2020 | F02D 41/0052 |
| JP | 2020197216 | A | * | 12/2020 | B60L 50/15 |
| JP | 2021110253 | A | * | 8/2021 | F02D 13/0215 |
| WO | WO-0140640 | A1 | * | 6/2001 | F01L 9/04 |
| WO | WO-2011001529 | A1 | * | 1/2011 | F02D 11/10 |
| WO | WO-2021079179 | A1 | * | 4/2021 | F02D 37/02 |
| WO | WO-2021178227 | A1 | * | 9/2021 | F02D 13/0203 |

* cited by examiner

ELECTRONIC VALVE CONTROL

CROSS-REFERENCE TO RELATED APPLICATIONS

The present application claims priority from U.S. Provisional Patent Application No. 62/984,029 entitled "ELECTRONIC VALVE CONTROL," filed Mar. 2, 2020, the contents of which are incorporated herein by reference in their entirety.

FIELD

The present disclosure is generally related to using trained models to control an electronically controllable valve in an engine.

BACKGROUND

Modern internal combustion engines include valves that are used to control passage of fluids, such as an intake valve that controls ingress of a fuel-air mixture into a combustion chamber (e.g., a piston cylinder) or an exhaust valve that controls egress of exhaust gasses from the combustion chamber. Conventionally, operation of such valves is mechanically controlled via a mechanical linkage in contact with a cam of a rotating camshaft. Properties of valve operation, such as valve lift, opening or closing speed, timing with respect to rotation of a crankshaft of the engine, and duration the valve remains in an open state or a closed state are controlled by the geometry of the cam that is associated with the valve. Although engine performance can be tuned by adjusting operation of the valves, the mechanical nature of the valve, the camshaft, and the mechanical linkage can cause such adjustments to be time consuming and costly.

SUMMARY

The present disclosure describes systems and methods that enable use of trained models to electronically control operation of valves in an engine, such as an internal combustion engine of a land-based vehicle or machinery, a water-based craft or machinery, an aircraft, a power generator or other engine-based equipment, etc.

In some aspects, a method of controlling an electronically controllable valve of an engine of a vehicle includes receiving, from one or more vehicle operation sensors, vehicle operation data including sensor data corresponding to a condition of the engine, control inputs indicative of operation of the vehicle, or a combination thereof. The method includes determining, using a trained valve control model, an operating characteristic of the valve at least partially based on the vehicle operation data, and generating a control signal to effect operation of the valve in accordance with the operating characteristic.

In some aspects, a vehicle includes an engine that has an electronically controllable valve coupled to a combustion chamber and configured to control flow into the combustion chamber, out of the combustion chamber, or both. The vehicle also includes a memory configured to store one or more trained models, and the one or more trained models include a valve control model. The vehicle includes one or more vehicle operation sensors configured to generate vehicle operation data. The vehicle operation data includes sensor data corresponding to a condition of the engine, control inputs indicative of operation of the vehicle, or a combination thereof. The vehicle also includes one or more processors configured to determine, using the valve control model, an operating characteristic of the valve at least partially based on the vehicle operation data and to generate a control signal to effect operation of the valve in accordance with the operating characteristic.

In some aspects, an apparatus for controlling an engine of a vehicle includes a memory configured to store one or more trained models, and the one or more trained models include a valve control model. The apparatus also includes one or more processors configured to receive vehicle operation data that includes sensor data corresponding to a condition of the engine, control inputs indicative of operation of the vehicle, or a combination thereof. The one or more processors are also configured to determine, using a trained valve control model, an operating characteristic of an electronically controllable valve of the engine at least partially based on the vehicle operation data, and to generate a control signal to effect operation of the valve in accordance with the operating characteristic.

In some aspects, a computer-readable storage device stores instructions that, when executed by one or more processors, cause the one or more processors to receive vehicle operation data that includes sensor data corresponding to a condition of an engine of a vehicle, control inputs indicative of operation of the vehicle, or a combination thereof. The instructions further cause the one or more processors to determine, using a trained valve control model, an operating characteristic of an electronically controllable valve of the engine at least partially based on the vehicle operation data and to generate a control signal to effect operation of the valve in accordance with the operating characteristic.

In some aspects, an apparatus for controlling an electronically controllable valve of an engine of a vehicle includes means for receiving vehicle operation data including sensor data corresponding to a condition of the engine, control inputs indicative of operation of the vehicle, or a combination thereof. The apparatus includes means for determining, using a trained valve control model, an operating characteristic of the valve at least partially based on the vehicle operation data. The apparatus also includes means for generating a control signal to effect operation of the valve in accordance with the operating characteristic.

In some aspects, a method of controlling an electronically controllable valve of an engine includes receiving, from one or more operation sensors, operation data including sensor data corresponding to a condition of the engine, control inputs indicative of operation of equipment that includes the engine, or a combination thereof. The method includes determining, using a trained valve control model, an operating characteristic of the valve at least partially based on the operation data, and generating a control signal to effect operation of the valve in accordance with the operating characteristic.

In some aspects, an apparatus for controlling an engine includes a memory configured to store one or more trained models, and the one or more trained models include a valve control model. The apparatus also includes one or more processors configured to receive operation data that includes sensor data corresponding to a condition of the engine, control inputs indicative of operation of equipment that includes the engine, or a combination thereof. The one or more processors are also configured to determine, using a trained valve control model, an operating characteristic of an electronically controllable valve of the engine at least partially based on the operation data, and to generate a control signal to effect operation of the valve in accordance with the operating characteristic.

In some aspects, a computer-readable storage device stores instructions that, when executed by one or more processors, cause the one or more processors to receive operation data that includes sensor data corresponding to a condition of an engine, control inputs indicative of operation of equipment that includes the engine, or a combination thereof. The instructions further cause the one or more processors to determine, using a trained valve control model, an operating characteristic of an electronically controllable valve of the engine at least partially based on the operation data and to generate a control signal to effect operation of the valve in accordance with the operating characteristic.

In some aspects, an apparatus for controlling an electronically controllable valve of an engine includes means for receiving operation data including sensor data corresponding to a condition of the engine, control inputs indicative of operation of equipment that includes the engine, or a combination thereof. The apparatus includes means for determining, using a trained valve control model, an operating characteristic of the valve at least partially based on the operation data. The apparatus also includes means for generating a control signal to effect operation of the valve in accordance with the operating characteristic.

DETAILED DESCRIPTION

Figure 1:
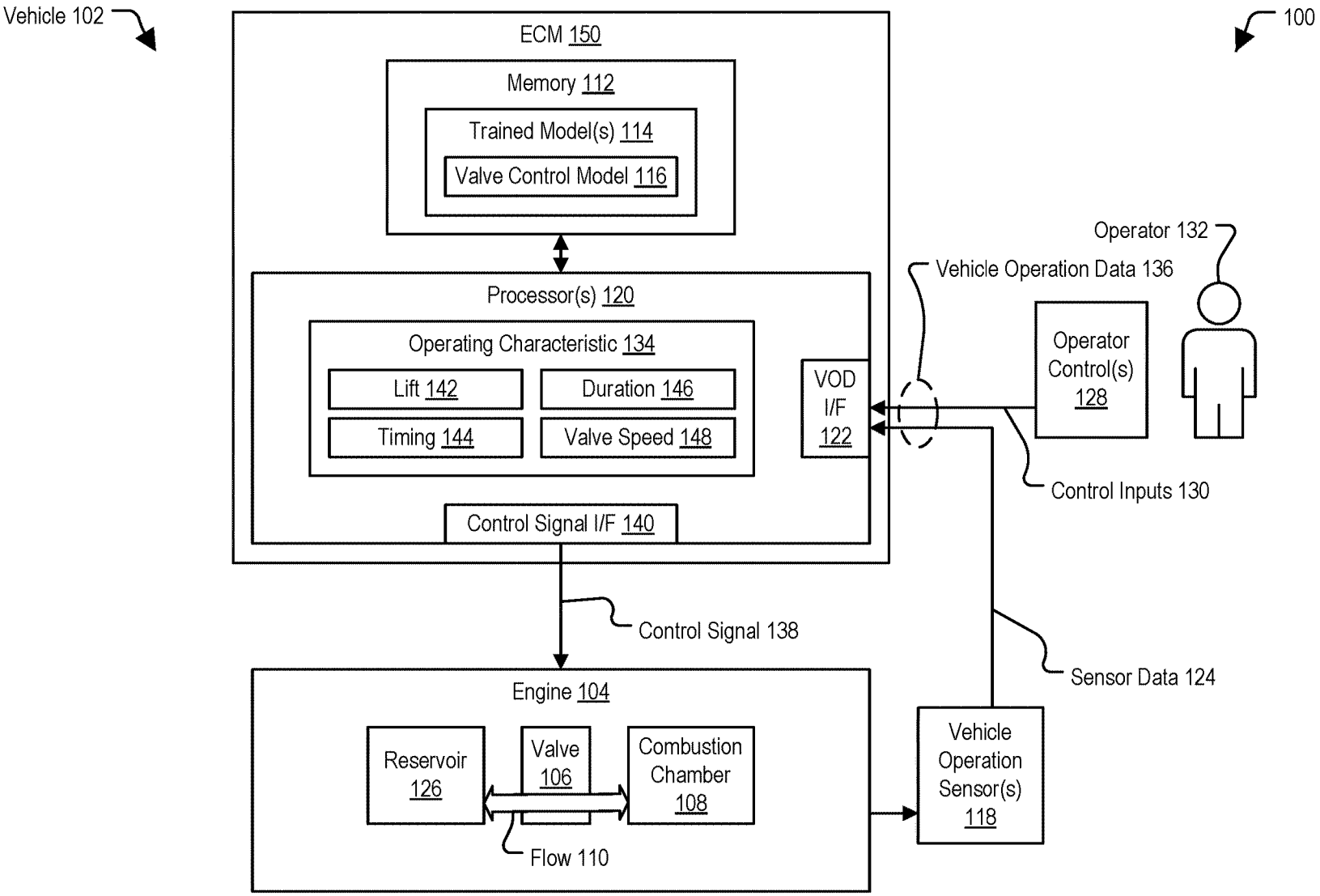
FIG. 1 illustrates a block diagram of a particular implementation of a vehicle that includes a valve control model to control operation of an electronically controllable valve of an engine in accordance with some examples of the present disclosure.

Particular aspects of the present disclosure are described below with reference to the drawings. In the description, common features are designated by common reference numbers throughout the drawings. As used herein, various terminology is used for the purpose of describing particular implementations only and is not intended to be limiting. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" a parameter (or a signal) may refer to actively generating, estimating, calculating, or determining the parameter (or the signal) or may refer to using, selecting, or accessing the parameter (or signal) that is already generated, such as by another component or device.

As used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive electrical signals (digital signals or analog signals) directly or indirectly, such as via one or more wires, buses, networks, etc. As used herein, "directly coupled" may include two devices that are coupled (e.g., communicatively coupled, electrically coupled, or physically coupled) without intervening components.

FIG. 1 depicts a system 100 that includes a vehicle 102 and an operator 132. The vehicle 102 includes an engine 104, a memory 112, and one or more operator controls 128 that are coupled to one or more processors 120. In various implementations, the vehicle 102 includes one or more of an aircraft (e.g., an airplane or unmanned aerial vehicle), a watercraft (e.g., a ship or submarine), or a land vehicle (e.g., an automobile), as illustrative, non-limiting examples. In alternate implementations, the engine 104 is part of a power generator or other non-transportation equipment. The vehicle 102 uses a trained valve control model 116 to control operation of an electronically controllable valve 106 for adjusting and improving operation of the engine 104 as compared to using a valve that is mechanically controlled via a camshaft. It is to be understood that although a single valve 106 is shown in FIG. 1 for ease of illustration, the engine 104 may include any number of electronically controllable valves, where each such valve is controllable independently of other valves. In such examples, each valve may have a separate valve control model, or in some cases multiple valves may be controlled using a single valve control model.

The memory 112 and the one or more processors 120 are incorporated in an electronic control module 150 ("ECM") that is coupled to the engine 104 and to the one or more operator controls 128. In some implementations, the memory 112 includes volatile memory devices, non-volatile memory devices, or both, such as one or more hard drives, solid-state storage devices (e.g., flash memory, magnetic memory, or phase change memory), a random access memory (RAM), a read-only memory (ROM), one or more other types of storage devices, or any combination thereof.

The memory 112 stores data and instructions (e.g., computer code) that are executable by the one or more processors 120. For example, the instructions can include one or more trained models 114 (e.g., trained machine learning models) that are executable by the one or more processors 120 to initiate, perform, or control various operations of the vehicle 102. The one or more processors 120 includes one or more single-core or multi-core central processing units (CPUs), one or more digital signal processors (DSPs), one or more graphics processing units (GPUs), or any combination thereof. Although the memory 112 and the one or more processors 120 are depicted in the electronic control module 150, in other implementations, one or both of the memory 112 and the one or more processors 120 is external to the electronic control module 150.

The engine 104 includes an electronically controllable valve 106 coupled to a combustion chamber 108. The combustion chamber 108 is coupled to a reservoir 126 via the valve 106. The valve 106 is configured to control flow 110 (e.g., gaseous flow) into the combustion chamber 108, out of the combustion chamber 108, or both. For example, the valve 106 can correspond to a cylinder valve (e.g., an intake valve or an exhaust valve) of an internal combustion engine that is controlled via a control signal 138 (or multiple control signals) from the one or more processors 120 instead of via physical actuation by a rotating camshaft. To illustrate, in a particular example, the engine 104 is a camless engine in which all cylinder valves are electronically controlled via a set of control signals (e.g., the control signal 138 represents, or is part of, a set of control signals for all cylinder valves). An example of operation of the valve 106 is provided in further detail with reference to FIG. 6. In some implementations, the engine 104 includes a gasoline-type engine, a diesel-type engine, or is adjustable to switch between diesel operation and gasoline operation, as illustrative, non-limiting examples. In some implementations, the engine 104 is configured to operate using carbon dioxide-free fuels (e.g., carbon-neutral fuels, such as synthetic hydrocarbons generated using renewable energy), renewable fuels (e.g., fossil-free fuels, such as biofuels), or one or more other environmentally friendly fuels.

The vehicle 102 also includes one or more vehicle operation sensors 118 configured to generate vehicle operation data 136. The vehicle operation data 136 includes sensor data 124 corresponding to a condition of the engine 104, control inputs 130 generated via vehicle operation sensors coupled to the one or more operator controls 128 and indicative of operation of the vehicle 102, or a combination thereof. Examples of the sensor data 124 include various measurements corresponding to temperatures, pressures, engine speed, battery condition, air intake and exhaust flows, exhaust oxygen levels, one or more other measurements, or any combination thereof. Examples of the control inputs 130 includes data representing position and movement of one or more operator controls 128, such as from one or more sensor coupled to an throttle (e.g., an accelerator pedal), a brake pedal, a clutch pedal, a steering wheel, a gear shift control, a traction control button, a ride height control, a cruise control, one or more other controls, or any combination thereof.

The memory 112 is configured to store one or more trained models 114 that are executable by the one or more processors 120 to determine operating characteristics related to the vehicle 102 based on various sensor and control inputs. For example, the one or more trained models 114 can include neural networks, classifiers, regression models, or other types of models, such as described further with reference to FIG. 5. As illustrated, the one or more trained models 114 include a valve control model 116 that is trained to determine, responsive to the vehicle operation data 136, an operating characteristic 134 corresponding to the valve 106, as described further below.

The one or more processors 120 include or are coupled to a vehicle operation data interface 122 ("VOD OF") that is configured to receive the vehicle operation data 136. For example, the vehicle operation data interface 122 receives the control inputs 130 from the one or more operator controls 128 and the sensor data 124 from the one or more vehicle operation sensors 118. In an illustrative implementation, the vehicle operation data interface 122 corresponds to an electrical or optical signal bus.

The one or more processors 120 are configured to determine, using the valve control model 116, an operating characteristic 134 of the valve 106 at least partially based on the vehicle operation data 136. In some implementations, the operating characteristic 134 corresponds to one or more of: a displacement of the valve 106 with respect to a particular position (e.g., a lift 142 of the valve 106 from a seated (closed) position), a timing 144 of the valve 106 (e.g., when to open and close the valve 106 based on angular positions of a crankshaft of the engine 104), a duration 146 of an open state or a closed state of the valve 106, or a valve speed 148 (e.g., how quickly the valve 106 opens and closes).

The one or more processors 120 are configured to generate the control signal 138, via a control signal interface 140, to effect operation of the valve 106 in accordance with the operating characteristic 134. In an illustrative implementation, the control signal interface 140 corresponds to an electrical or optical signal bus.

During operation of the vehicle 102, a control loop for operation of the valve 106 includes receiving the vehicle operation data 136 (e.g., the control inputs 130 from the one or more operator controls 128 and the sensor data 124 indicating a state of the engine 104), inputting at least a portion of the vehicle operation data 136 to the valve control model 116 to generate the operating characteristic 134, and sending the control signal 138 based on the operating characteristic 134 to adjust operation of the valve 106. Adjusting operation of the valve 106 affects performance of the engine 104 and therefore affects performance of the vehicle 102.

The valve control model 116 is trained to optimize or balance one or more characteristics of the engine 104, such as power output, torque production, fuel efficiency, emissions, responsiveness, and engine longevity, as illustrative, non-limiting examples. In some implementations, the valve control model 116 is generated and installed by a manufacturer of the vehicle 102 based on experimental or test data generated using one or more test vehicles, the vehicle 102 itself, or a combination thereof. The valve control model 116 may indicate default values that enhance operation of the vehicle 102, as compared to conventional non-adjustable cam-operated valves, by tuning the performance of the engine 104 based on the state of the engine 104 and the control inputs 130 responsive to the operator 132 of the vehicle 102. The operator 132 can be within the vehicle 102, such as within a cabin or cockpit of the vehicle 102, or remote from the vehicle 102, such as in implementations in which the one or more operator controls 128 includes a remote controller for the vehicle 102 (e.g., for remote control of the vehicle 102 via wireless signaling).

In some implementations, the valve control model 116 can be updated after a period of use of the vehicle 102. For example, the one or more processors 120 may be configured to store a history of the vehicle operation data 136 and to update (e.g., periodically, continuously, or according to some other schedule) the valve control model 116, such as to adapt to changes in engine performance, changes in performance requirements of the operator 132 as inferred from the control inputs 130, or changes due to external factors (e.g., environmental regulations regarding emissions or instructions received from an external authority), as illustrative, non-limiting examples. Alternatively, or in addition, such history information may be transmitted to a remote system (e.g., to a cloud-based server system via a wireless network) that determines such updates and pushes data indicative of the updated valve control model 116 to the vehicle 102. In some implementations, update of the valve control model 116 is further based on aggregated data from multiple vehicles, such as by using historical data of a group of vehicles sharing similar aspects as the vehicle 102. Thus, in various implementations, valve control may be dynamically adjusted due to characteristics (or changes in characteristics) of the vehicle 102, the operator 132, the weather or other environmental factors, vehicle regulations, etc.

Use of the one or more trained models 114 to control valve operation enables operation of the engine 104 with more power, higher fuel efficiency, or both, as compared to using mechanical linkages to operate the valves and also as compared to using pre-programmed valve control or control based on simple heuristics. In addition, or alternatively, controlling operation of the engine 104 using the one or more trained models 114 enables a smaller and lighter engine to be used in the vehicle 102 with equivalent or improved performance as compared to conventional engines. Reduced engine size and weight enables improved fuel efficiency and relaxed design constraints as compared to using larger, heavier engines. In a particular example, using a smaller engine enables the engine to be positioned lower in the vehicle 102, lowering the center of gravity of the vehicle 102 and enabling improved handling, road grip, etc. Although fuel efficiency is generally improved due to reduced engine size and weight, using the one or more trained models 114 to control valve operation specifically enables the engine 104 to operate with enhanced fuel efficiency as compared to using mechanical linkages to operate the valves and also as compared to using pre-programmed valve control or control based on simple heuristics.

Although in some implementations the engine 104 is an internal combustion-type engine, in other implementations the engine 104 is a hybrid engine, such as a hybrid electric-petroleum engine that also includes electric motors and a battery set. In such implementations, the sensor data 124 may further include data corresponding to electrical components of the engine 104, such as battery charge and current-voltage characteristics, as illustrative, non-limiting examples. The one or more trained models 114 may be configured to adjust valve operation further based on the state of the electrical components, such as to tune the internal combustion engine to enhance fuel efficiency while maintaining vehicle performance in parallel hybrid configuration, or to enhance internal combustion engine performance in a power-split hybrid configuration in response to detection of depleted battery charge, as illustrative, non-limiting examples.

Although the one or more trained models 114 are described as including the valve control model 116, in other implementations the one or more trained models 114 also includes other trained models that can provide inputs to, or operate in parallel with, the valve control model 116. Other trained models that may be included in the one or more trained models 114 include a travel type model, a fleet operation model, an operator type model, or any combination thereof, as described further with reference to FIGS. 2-4B.

Figure 2:
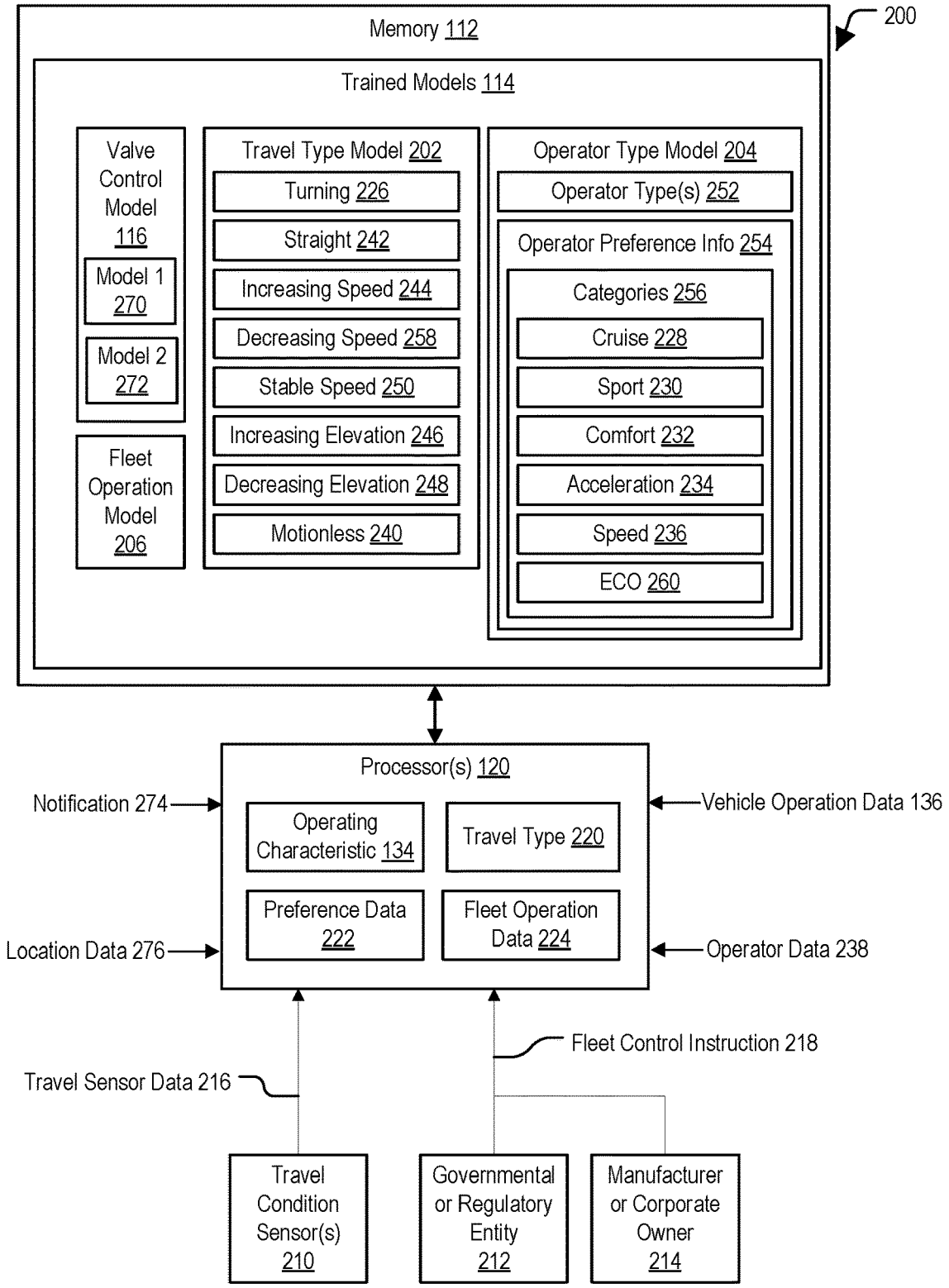
FIG. 2 is a block diagram of components that may be included in the vehicle of FIG. 1 in accordance with some examples of the present disclosure.

FIG. 2 depicts a block diagram 200 of a particular implementation of components that can be included in the vehicle 102 in conjunction with controlling the valve 106 using one or more additional trained models 114. As illustrated, in addition to the valve control model 116, the one or more trained models 114 include a travel type model 202, an operator type model 204, and a fleet operation model 206.

The vehicle 102 includes one or more travel condition sensors 210 that are configured to generate travel sensor data 216 corresponding to a travel condition. In an illustrative example, the one or more travel condition sensors 210 can correspond to one or more magnetic compasses, accelerometers, location or positioning sensors, cameras, pressure sensors, temperature sensors, altimeters, or any other sensor that can generate data indicative of a travel condition. The one or more processors 120 are configured to determine, using the travel type model 202, a travel type 220 based on the travel sensor data 216, and to determine the operating characteristic 134 further based on the travel type 220. For example, in a particular implementation, the travel type model 202 is configured to process the travel sensor data 216 to select the travel type 220 from among a plurality of travel types based on the travel sensor data 216. In an illustrative implementation, the plurality of travel types includes at least one of: turning 226, straight travel 242, increasing speed 244, decreasing speed 258, stable speed 250, increasing elevation 246, decreasing elevation 248, or motionless 240. In other implementations, other travel types may be used in place of, or in addition to, any or all of the travel types illustrated in FIG. 2. For example, in implementations in which the vehicle 102 is an aircraft, the travel type model 202 may be configured to select from among different travel types as compared to implementations in which the vehicle 102 is a land vehicle or a watercraft.

The one or more processors 120 are further configured to determine, using the operator type model 204, preference data 222 corresponding to an operator of the vehicle 102 (e.g., the operator 132), and to determine the operating characteristic 134 further based on the preference data 222. For example, the one or more processors 120 may receive operator data 238 indicating an identity of an operator of the vehicle 102, measured characteristics of the operator 132 (such as data corresponding to the control inputs 130, biometric data such as voice, facial recognition, weight, etc., or other data that is indicative of the operator 132) to enable selection of a particular operator profile or determination of a particular one of one or more operator types 252. Examples of the operator types 252 can include aggressive, defensive or conservative, abrupt, smooth, and high-performance, one or more other operator types, or any combination thereof.

In a particular implementation, the operator type model 204 includes, for each of the one or more operator types 252, operator preference information 254 regarding a plurality of travel types. As an illustrative example, the operator preference information 254 indicates a preference for one or more categories 256 corresponding to at least one of cruise 228, sport 230, comfort 232, acceleration 234, speed 236, or economy ("ECO") 260. Each of the one or more categories 256 can correspond a type of vehicle performance that is preferred, or predicted to be preferred, by a particular operator 132 or operator type based on each particular type of travel of the vehicle 102. As an example, the operator type model 204 may determine that an "aggressive" operator type prefers that the vehicle 102 operate according to the acceleration 234 category (e.g., adjusting throttle response, transmission shift points, etc. for improved power and performance), when the determined travel type 220 corresponds to straight travel 242 and that a "conservative" operator type prefers that the vehicle 102 operates according to the ECO 260 category (e.g., adjusting throttle response, transmission shift points, etc. for improved fuel efficiency) when the travel type 220 corresponds to straight travel 242. As another example, the operator type model 204 may determine that an "aggressive" operator type prefers that the vehicle 102 operates according to the sport 230 category when the determined travel type 220 corresponds to turning 226 and that a "conservative" operator type prefers that the vehicle 102 operate according to the comfort 232 category when the travel type 220 corresponds to turning 226.

In a particular implementation, the one or more processors 120 are further configured to determine, using the fleet operation model 206, fleet operation data 224 corresponding to a fleet control instruction 218 that is received at the vehicle 102 and to determine the operating characteristic 134 further based on the fleet operation data 224. In some examples, the fleet control instruction 218 corresponds to an instruction from a governmental or regulatory entity 212. To illustrate, a municipality may issue a fleet control instruction 218 instructing vehicles to operate in a lowered-emission mode in response to air pollution levels exceeding a threshold amount. In other example, the fleet control instruction 218 corresponds to an instruction from a manufacturer or corporate owner 214 of the vehicle 102. To illustrate, an owner of a fleet of vehicles including the vehicle 102 (e.g., the vehicle 102 may be a commercial aircraft owned by an airline or a delivery truck owned by a business) may issue the fleet control instruction 218 instructing vehicles in the fleet to operate in an increased fuel-efficiency mode in response to an increase in fuel prices.

The travel type 220, the preference data 222, and the fleet operation data 224 are used in conjunction with the vehicle operation data 136 to determine the operating characteristic 134, which in turn is used to generate the control signal 138. The operating characteristic 134 may generally correspond to a default value based on the vehicle operation data 136, as modified or adjusted based on the operator's preference, based on the type of travel indicated by the travel type 220, and responsive to the fleet control instruction 218. Thus, various independent (and potentially competing) criteria may be factored into the final determination of how the valve 106 is to be controlled.

Further, the valve control model 116 includes multiple selectable models, illustrated as a first model 270 and a second model 272. The valve control model 116 is configured to select a particular model from among the multiple selectable models 270-272 to generate the operating characteristic 134. As a first example, the first model 270 may be trained for operating the engine 104 and may be updated periodically as described above. The first model 270 may be configured to enhance (e.g., maximize) one or more aspects of performance, such as horsepower, torque, fuel efficiency, etc., in conformance with a regulatory requirement, such as fuel efficiency or emissions restrictions. However, if the regulatory requirement is updated (e.g., emissions are further restricted), operation of the vehicle 102 in accordance with the first model 270 may result in the vehicle 102 being in violation of the updated regulatory requirement. In response to announcement or promulgation of the updated regulatory requirement, the second model 272 may be generated and provided to the memory 112 (e.g., via wireless data transmission) to enable operation of the vehicle 102 in conformance with the updated regulatory requirement. The vehicle 102 may continue to use the first model 270 until a notification 274 is received, such as from a manufacturer of the vehicle 102, to deselect the first model 270 and to select the second model 272. As a result, when a new regulation on fuel efficiency or emissions is promulgated, the vehicle 102 can remain in compliance with the new regulation with negligible cost as compared to conventional alternatives, such as upgrading or replacing the vehicle 102.

As a second example, the first model 270 may be trained for operating the engine 104 in compliance with regulations of a first jurisdiction, and the second model 272 may be trained for operating the engine 104 in compliance with regulations of a second jurisdiction. Location data 276 (e.g., Global Positioning System (GPS) data, one or more other types of location data, or any combination thereof) may be received at the one or more processors 120 and compared to jurisdiction boundary data to determine which jurisdiction the vehicle 102 is located in and to select the appropriate one of the first model 270 and the second model 272. Although two models 270, 272 are illustrated, in other implementations any number of models may be trained, downloaded, stored, and selected from during operation of the vehicle 102.

As a third example, one or more additional models may be included for various uses of the vehicle 102 within a particular jurisdiction. For example, a particular jurisdiction may enact strict emissions regulations but may provide an exception for vehicles operating on a racetrack. Thus, the vehicle 102 may operate using the first model 270 to comply with that jurisdiction's strict emissions requirements, and when the location data 276 indicates that the vehicle 102 has entered (or is within) a geographic boundary of a racetrack (e.g., within a geofence around the racetrack), the second model 272 may be selected to enable the vehicle 102 to operate in a higher-performance mode. Other location-based models may be used based on particular jurisdictional requirements, such as for regulations that distinguish between urban and rural operation, as an illustrative, non-limiting examples.

Although descriptive labels are used to provide examples of various categories and classes associated with the trained models 114 for purpose of explanation, it should be understood that the various categories and classes used by one or more of the trained models 114 may be determined based on processing empirical data, such as using an unsupervised machine learning clustering analysis, as a non-limiting example. For example, the travel types used by the travel type model 202, the operator types 252 used by the operator type model 204, the categories 256 used by the operator type model 204, or any combination thereof, may be generated based on supervised or unsupervised analysis of data from one or more sources, such as an aggregated history of sensor data and operator control data from a fleet of vehicles. Such categories and classes are subject to change as additional data collection and analysis results in updated models that are provided to the vehicle 102. In some examples, valve control models may be generated based on reinforcement learning with respect to an engine performance simulator environment.

Although FIG. 2 depicts an implementation that uses four trained models 114, in other implementations, one or more of the trained models 114 may be omitted, one or more additional models may be included, or any combination thereof. Examples of various implementations that include different combinations of the valve control model 116, the travel type model 202, the operator type model 204, and the fleet operation model 206 are described with reference to FIGS. 3A-3C and FIGS. 4A-4B.

Figure 3A:
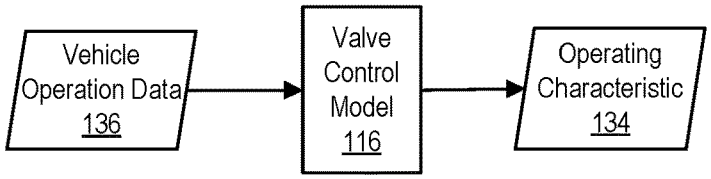
FIG. 3A is a data flow diagram of a particular example of using a trained model to determine an operating characteristic associated with the electronically controllable valve of FIG. 1 in accordance with some examples of the present disclosure.
Figure 3B:
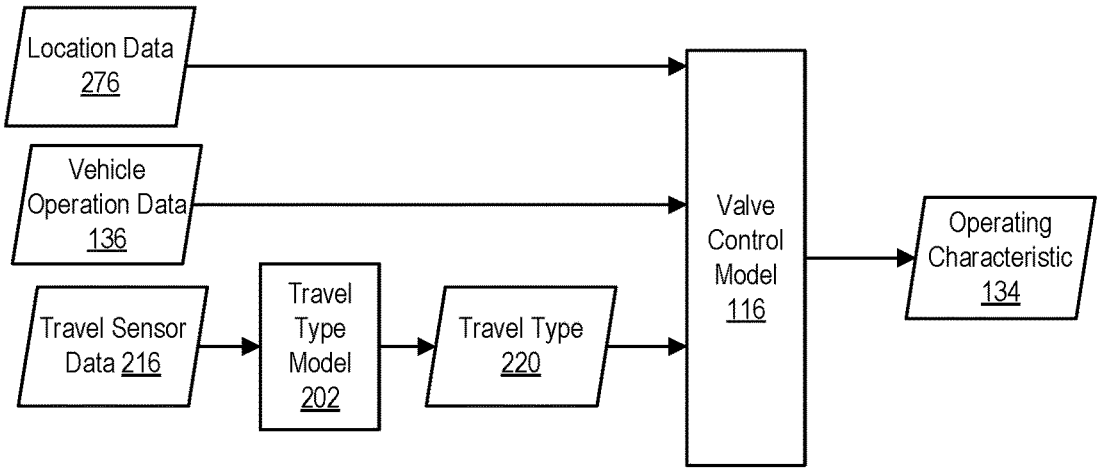
FIG. 3B is a data flow diagram of a particular example of using multiple trained models to determine an operating characteristic associated with the electronically controllable valve of FIG. 1 in accordance with some examples of the present disclosure.
Figure 3C:
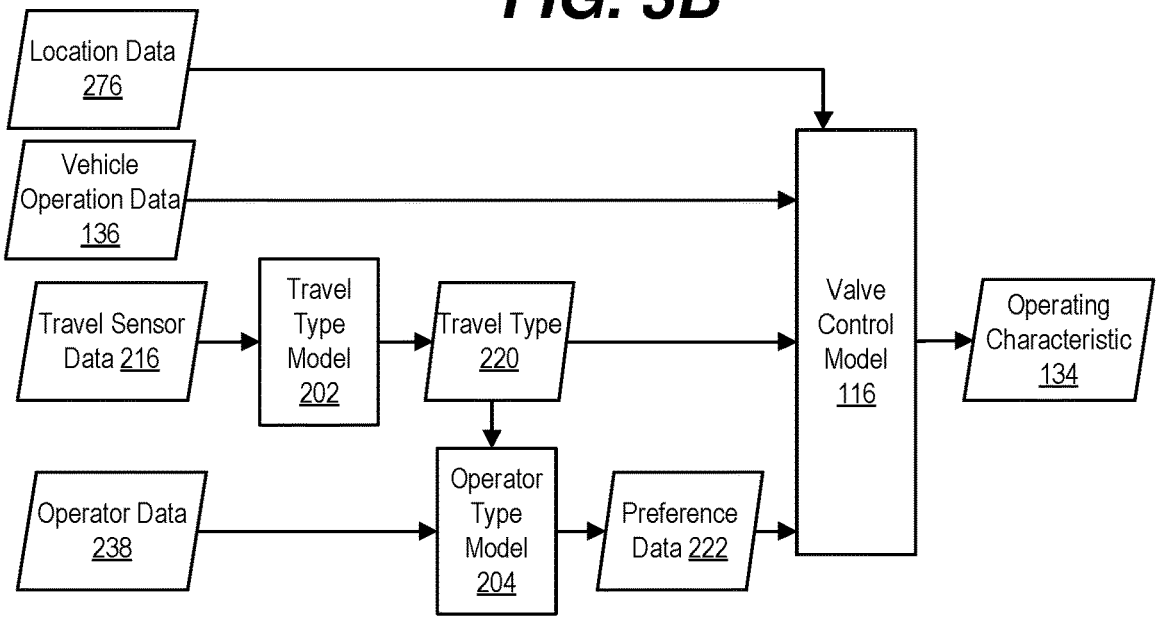
FIG. 3C is a data flow diagram of another example of using multiple trained models to determine an operating characteristic associated with the electronically controllable valve of FIG. 1 in accordance with some examples of the present disclosure.

FIGS. 3A-3C depict block diagrams of various examples of operation in which the one or more trained models 114 are used to determine the 134. FIG. 3A corresponds to an implementation in which the vehicle operation data 136 is received and processed by the valve control model 116 to generate the operating characteristic 134, such as described with reference to FIG. 1. For example, the valve control model 116 can include a classifier that maps the vehicle operation data 136 to a discrete value or set of values of the lift 142, timing 144, duration 146, and valve speed 148 that are output as the operating characteristic 134. As another example, the valve control model 116 can include a regression model that maps the vehicle operation data 136 to particular values of a set of continuous values corresponding to the lift 142, timing 144, duration 146, and valve speed 148 that are output as the operating characteristic 134.

FIG. 3B corresponds to an implementation that includes the valve control model 116 and the travel type model 202. The travel type model 202 receives and processes the travel sensor data 216 and outputs the travel type 220. The valve control model 116 receives the vehicle operation data 136, the location data 276, and the travel type 220 as inputs. The valve control model 116 is configured to process the vehicle operation data 136 in conjunction with the travel type 220 and the location data 276 to determine the operating characteristic 134.

FIG. 3C corresponds to an implementation that includes the valve control model 116, the travel type model 202, and the operator type model 204. The travel type model 202 receives and processes the travel sensor data 216 and outputs the travel type 220. The operator type model 204 receives and processes the travel type 220 and the operator data 238 to determine the preference data 222. The valve control model 116 receives the vehicle operation data 136, the location data 276, the travel type 220, and the preference data 222 as inputs. The valve control model 116 is configured to process the vehicle operation data 136 in conjunction with the location data 276, the travel type 220 and the preference data 222 to determine the operating characteristic 134.

Figure 4A:
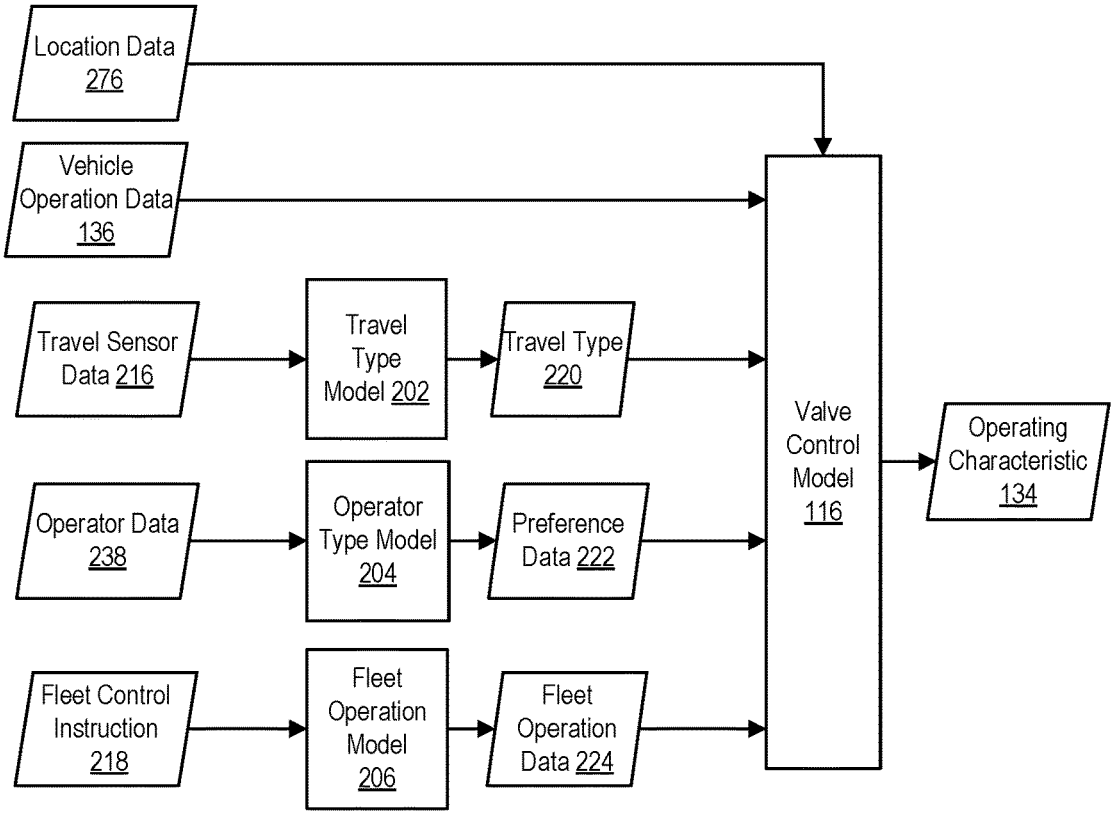
FIG. 4A is a data flow diagram of another example of using multiple trained models to determine an operating characteristic associated with the electronically controllable valve of FIG. 1 in accordance with some examples of the present disclosure.

FIG. 4A corresponds to an implementation that includes the valve control model 116, the travel type model 202, the operator type model 204, and the fleet operation model 206. The travel type model 202 receives and processes the travel sensor data 216 and outputs the travel type 220. The operator type model 204 receives and processes the operator data 238 and outputs the preference data 222, although in other implementations the operator type model 204 is also responsive to the travel type 220. The fleet operation model 206 receives and processes the fleet control instruction 218 and outputs the fleet operation data 224. The valve control model 116 receives the vehicle operation data 136, the location data 276, the travel type 220, the preference data 222, and the fleet operation data 224 as inputs. The valve control model 116 is configured to process the vehicle operation data 136 in conjunction with the location data 276, the travel type 220, the preference data 222, and the fleet operation data 224 to determine the operating characteristic 134.

Figure 4B:
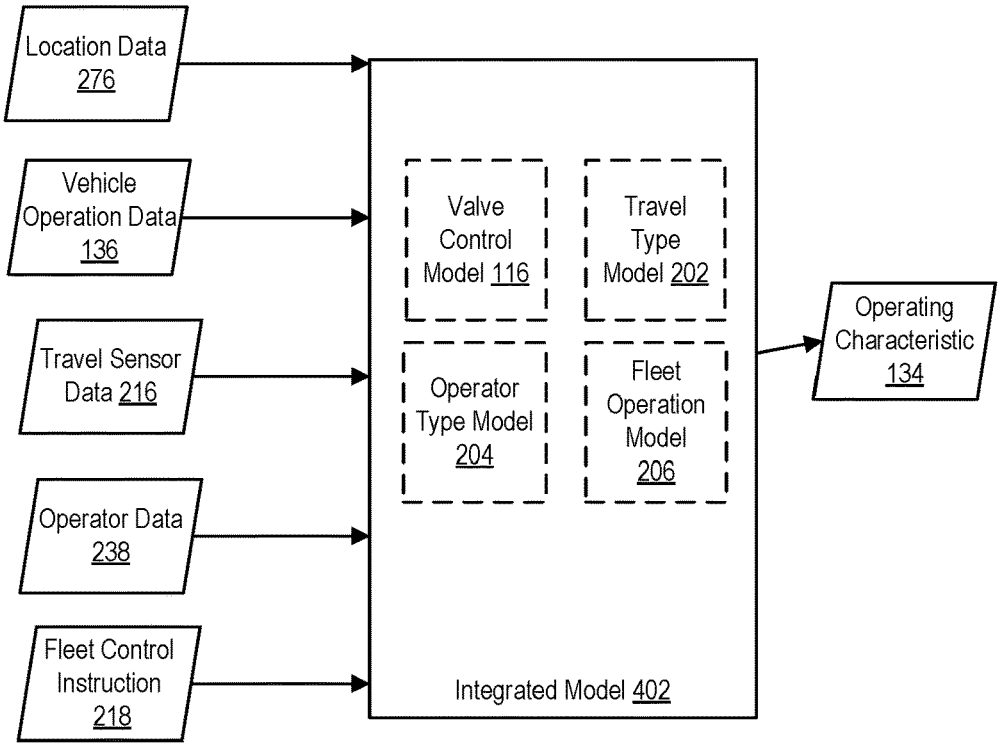
FIG. 4B is a data flow diagram of a particular example of using an integrated model to determine an operating characteristic associated with the electronically controllable valve of FIG. 1 in accordance with some examples of the present disclosure.

In contrast to FIGS. 3A-3C and FIG. 4A, in which the valve control model 116 generates the operating characteristic 134 based on received inputs that include one or more of the vehicle operation data 136, the location data 276, the travel type 220, the preference data 222, and the fleet operation data 224, FIG. 4B depicts an implementation in which an integrated model 402 is configured to generate the operating characteristic 134 based on inputs including the travel sensor data 216, the operator data 238, the fleet control instruction 218, and the vehicle operation data 136. The integrated model 402 includes functionality associated with the valve control model 116, the travel type model 202, the operator type model 204, and the fleet operation model 206, although the valve control model 116, the travel type model 202, the operator type model 204, and the fleet operation model 206 are not implemented as discrete, separate components as in FIG. 4A.

Implementing the valve control model 116, the travel type model 202, the operator type model 204, and the fleet operation model 206 as discrete components as in FIG. 4A enables smaller, less complex individual modules that may be independently updated, using reduced processing resources, as compared to updating a single integrated model. However, using the single integrated model 402 of FIG. 4B enables the operating characteristic 134 to be determined based on the combined inputs with enhanced accuracy as compared to using the multiple independent models of FIG. 4A.

Figure 5:
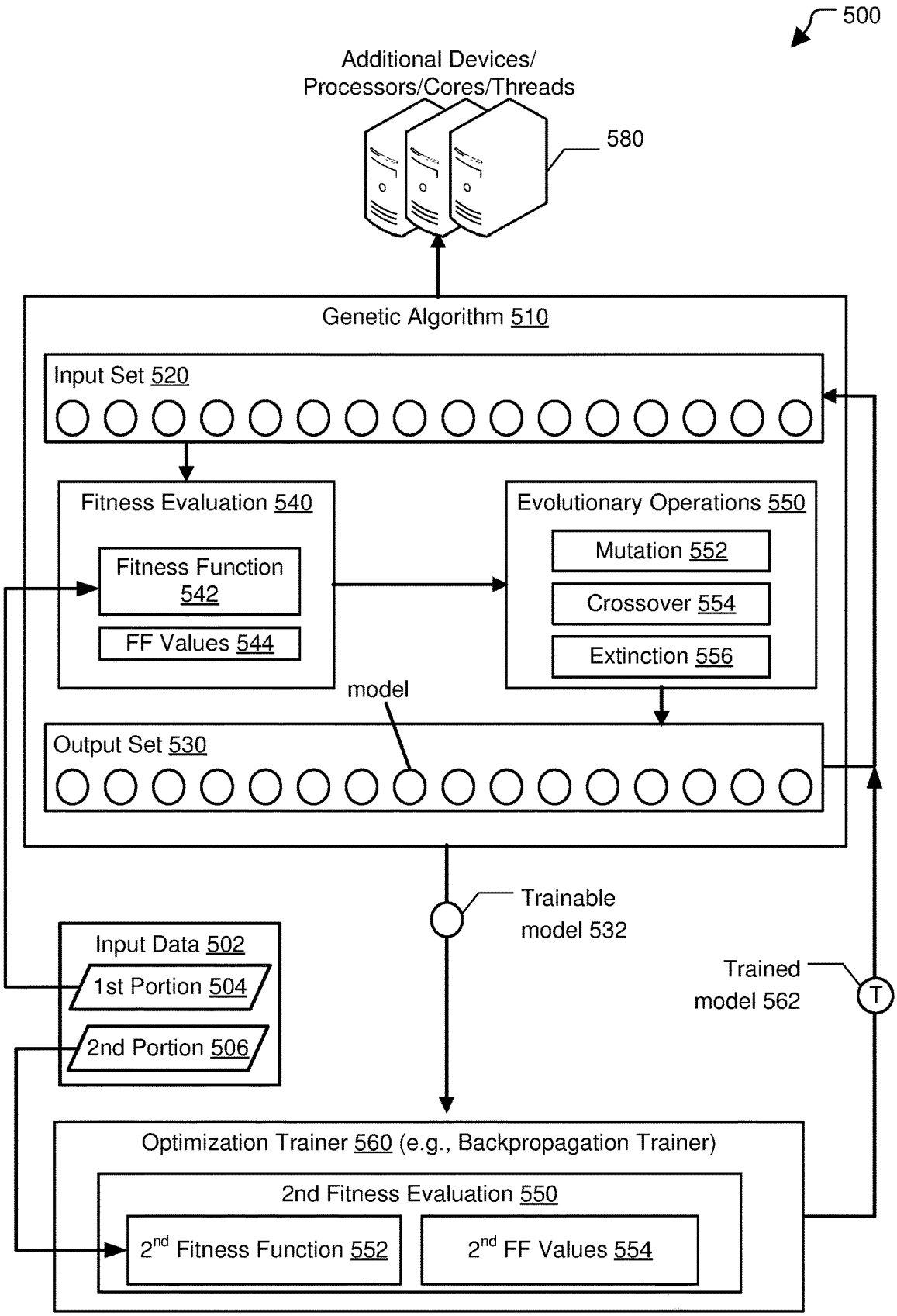
FIG. 5 is a diagram of a particular example of a system to generate one or more trained models that are used in conjunction with controlling the electronically controllable valve of FIG. 1 in accordance with some examples of the present disclosure.

Referring to FIG. 5, a particular illustrative example of a system 500 for generating a machine learning data model, such as one or more of the trained models 114, that can be used by the one or more processors 120, the ECM 150, or the vehicle 102 is shown. Although FIG. 5 depicts a particular example for purpose of explanation, in other implementations other systems may be used for generating or updating one or more of the trained models 114.

The system 500, or portions thereof, may be implemented using (e.g., executed by) one or more computing devices, such as laptop computers, desktop computers, mobile devices, servers, and Internet of Things devices and other devices utilizing embedded processors and firmware or operating systems, etc. In the illustrated example, the system 500 includes a genetic algorithm 510 and an optimization trainer 560. The optimization trainer 560 is, for example, a backpropagation trainer, a derivative free optimizer (DFO), an extreme learning machine (ELM), etc. In particular implementations, the genetic algorithm 510 is executed on a different device, processor (e.g., central processor unit (CPU), graphics processing unit (GPU) or other type of processor), processor core, and/or thread (e.g., hardware or software thread) than the optimization trainer 560. The genetic algorithm 510 and the optimization trainer 560 are executed cooperatively to automatically generate a machine learning data model (e.g., one of the trained models 114 of FIGS. 1-2, such as depicted in FIGS. 3A-4B and referred to herein as "models" for ease of reference), such as a neural network or an autoencoder, based on the input data 502. The system 500 performs an automated model building process that enables users, including inexperienced users, to quickly and easily build highly accurate models based on a specified data set.

During configuration of the system 500, a user specifies the input data 502. In some implementations, the user can also specify one or more characteristics of models that can be generated. In such implementations, the system 500 constrains models processed by the genetic algorithm 510 to those that have the one or more specified characteristics. For example, the specified characteristics can constrain allowed model topologies (e.g., to include no more than a specified number of input nodes or output nodes, no more than a specified number of hidden layers, no recurrent loops, etc.). Constraining the characteristics of the models can reduce the computing resources (e.g., time, memory, processor cycles, etc.) needed to converge to a final model, can reduce the computing resources needed to use the model (e.g., by simplifying the model), or both.

The user can configure aspects of the genetic algorithm 510 via input to graphical user interfaces (GUIs). For example, the user may provide input to limit a number of epochs that will be executed by the genetic algorithm 510. Alternatively, the user may specify a time limit indicating an amount of time that the genetic algorithm 510 has to execute before outputting a final output model, and the genetic algorithm 510 may determine a number of epochs that will be executed based on the specified time limit. To illustrate, an initial epoch of the genetic algorithm 510 may be timed (e.g., using a hardware or software timer at the computing device executing the genetic algorithm 510), and a total number of epochs that are to be executed within the specified time limit may be determined accordingly. As another example, the user may constrain a number of models evaluated in each epoch, for example by constraining the size of an input set 520 of models and/or an output set 530 of models.

The genetic algorithm 510 represents a recursive search process. Consequently, each iteration of the search process (also called an epoch or generation of the genetic algorithm 510) has an input set 520 of models (also referred to herein as an input population) and an output set 530 of models (also referred to herein as an output population). The input set 520 and the output set 530 may each include a plurality of models, where each model includes data representative of a machine learning data model. For example, each model may specify a neural network or an autoencoder by at least an architecture, a series of activation functions, and connection weights. The architecture (also referred to herein as a topology) of a model includes a configuration of layers or nodes and connections therebetween. The models may also be specified to include other parameters, including but not limited to bias values/functions and aggregation functions.

For example, each model can be represented by a set of parameters and a set of hyperparameters. In this context, the hyperparameters of a model define the architecture of the model (e.g., the specific arrangement of layers or nodes and connections), and the parameters of the model refer to values that are learned or updated during optimization training of the model. For example, the parameters include or correspond to connection weights and biases.

In a particular implementation, a model is represented as a set of nodes and connections therebetween. In such implementations, the hyperparameters of the model include the data descriptive of each of the nodes, such as an activation function of each node, an aggregation function of each node, and data describing node pairs linked by corresponding connections. The activation function of a node is a step function, sine function, continuous or piecewise linear function, sigmoid function, hyperbolic tangent function, or another type of mathematical function that represents a threshold at which the node is activated. The aggregation function is a mathematical function that combines (e.g., sum, product, etc.) input signals to the node. An output of the aggregation function may be used as input to the activation function.

In another particular implementation, the model is represented on a layer-by-layer basis. For example, the hyperparameters define layers, and each layer includes layer data, such as a layer type and a node count. Examples of layer types include fully connected, long short-term memory (LSTM) layers, gated recurrent units (GRU) layers, and convolutional neural network (CNN) layers. In some implementations, all of the nodes of a particular layer use the same activation function and aggregation function. In such implementations, specifying the layer type and node count fully may describe the hyperparameters of each layer. In other implementations, the activation function and aggregation function of the nodes of a particular layer can be specified independently of the layer type of the layer. For example, in such implementations, one fully connected layer can use a sigmoid activation function and another fully connected layer (having the same layer type as the first fully connected layer) can use a tanh activation function. In such implementations, the hyperparameters of a layer include layer type, node count, activation function, and aggregation function. Further, a complete autoencoder is specified by specifying an order of layers and the hyperparameters of each layer of the autoencoder.

In a particular aspect, the genetic algorithm 510 may be configured to perform speciation. For example, the genetic algorithm 510 may be configured to cluster the models of the input set 520 into species based on "genetic distance" between the models. The genetic distance between two models may be measured or evaluated based on differences in nodes, activation functions, aggregation functions, connections, connection weights, layers, layer types, latent-space layers, encoders, decoders, etc. of the two models. In an illustrative example, the genetic algorithm 510 may be configured to serialize a model into a bit string. In this example, the genetic distance between models may be represented by the number of differing bits in the bit strings corresponding to the models. The bit strings corresponding to models may be referred to as "encodings" of the models.

After configuration, the genetic algorithm 510 may begin execution based on the input data 502. Parameters of the genetic algorithm 510 may include but are not limited to, mutation parameter(s), a maximum number of epochs the genetic algorithm 510 will be executed, a termination condition (e.g., a threshold fitness value that results in termination of the genetic algorithm 510 even if the maximum number of generations has not been reached), whether parallelization of model testing or fitness evaluation is enabled, whether to evolve a feedforward or recurrent neural network, etc. As used herein, a "mutation parameter" affects the likelihood of a mutation operation occurring with respect to a candidate neural network, the extent of the mutation operation (e.g., how many bits, bytes, fields, characteristics, etc. change due to the mutation operation), and/or the type of the mutation operation (e.g., whether the mutation changes a node characteristic, a link characteristic, etc.). In some examples, the genetic algorithm 510 uses a single mutation parameter or set of mutation parameters for all of the models. In such examples, the mutation parameter may impact how often, how much, and/or what types of mutations can happen to any model of the genetic algorithm 510. In alternative examples, the genetic algorithm 510 maintains multiple mutation parameters or sets of mutation parameters, such as for individual or groups of models or species. In particular aspects, the mutation parameter(s) affect crossover and/or mutation operations, which are further described below.

For an initial epoch of the genetic algorithm 510, the topologies of the models in the input set 520 may be randomly or pseudo-randomly generated within constraints specified by the configuration settings or by one or more architectural parameters. Accordingly, the input set 520 may include models with multiple distinct topologies. For example, a first model of the initial epoch may have a first topology, including a first number of input nodes associated with a first set of data parameters, a first number of hidden layers including a first number and arrangement of hidden nodes, one or more output nodes, and a first set of interconnections between the nodes. In this example, a second model of the initial epoch may have a second topology, including a second number of input nodes associated with a second set of data parameters, a second number of hidden layers including a second number and arrangement of hidden nodes, one or more output nodes, and a second set of interconnections between the nodes. The first model and the second model may or may not have the same number of input nodes and/or output nodes. Further, one or more layers of the first model can be of a different layer type that one or more layers of the second model. For example, the first model can be a feedforward model, with no recurrent layers; whereas, the second model can include one or more recurrent layers.

The genetic algorithm 510 may automatically assign an activation function, an aggregation function, a bias, connection weights, etc. to each model of the input set 520 for the initial epoch. In some aspects, the connection weights are initially assigned randomly or pseudo-randomly. In some implementations, a single activation function is used for each node of a particular model. For example, a sigmoid function may be used as the activation function of each node of the particular model. The single activation function may be selected based on configuration data. For example, the configuration data may indicate that a hyperbolic tangent activation function is to be used or that a sigmoid activation function is to be used. Alternatively, the activation function may be randomly or pseudo-randomly selected from a set of allowed activation functions, and different nodes or layers of a model may have different types of activation functions. Aggregation functions may similarly be randomly or pseudo-randomly assigned for the models in the input set 520 of the initial epoch. Thus, the models of the input set 520 of the initial epoch may have different topologies (which may include different input nodes corresponding to different input data fields if the data set includes many data fields) and different connection weights. Further, the models of the input set 520 of the initial epoch may include nodes having different activation functions, aggregation functions, and/or bias values/functions.

During execution, the genetic algorithm 510 performs fitness evaluation 540 and evolutionary operations 550 on the input set 520. In this context, fitness evaluation 540 includes evaluating each model of the input set 520 using a fitness function 542 to determine a fitness function value 544 ("FF values" in FIG. 5) for each model of the input set 520. The fitness function values 544 are used to select one or more models of the input set 520 to modify using one or more of the evolutionary operations 550. In FIG. 5, the evolutionary operations 550 include mutation operations 552, crossover operations 554, and extinction operations 556, each of which is described further below.

During the fitness evaluation 540, each model of the input set 520 is tested based on the input data 502 to determine a corresponding fitness function value 544. For example, a first portion 504 of the input data 502 may be provided as input data to each model, which processes the input data (according to the network topology, connection weights, activation function, etc., of the respective model) to generate output data. The output data of each model is evaluated using the fitness function 542 and the first portion 504 of the input data 502 to determine how well the model modeled the input data 502. In some examples, fitness of a model is based on reliability of the model, performance of the model, complexity (or sparsity) of the model, size of the latent space, or a combination thereof.

In a particular aspect, fitness evaluation 540 of the models of the input set 520 is performed in parallel. To illustrate, the system 500 may include devices, processors, cores, and/or threads 580 in addition to those that execute the genetic algorithm 510 and the optimization trainer 560. These additional devices, processors, cores, and/or threads 580 can perform the fitness evaluation 540 of the models of the input set 520 in parallel based on a first portion 504 of the input data 502 and may provide the resulting fitness function values 544 to the genetic algorithm 510.

The mutation operation 552 and the crossover operation 554 are highly stochastic under certain constraints and a defined set of probabilities optimized for model building, which produces reproduction operations that can be used to generate the output set 530, or at least a portion thereof, from the input set 520. In a particular implementation, the genetic algorithm 510 utilizes intra-species reproduction (as opposed to inter-species reproduction) in generating the output set 530. In other implementations, inter-species reproduction may be used in addition to or instead of intra-species reproduction to generate the output set 530. Generally, the mutation operation 552 and the crossover operation 554 are selectively performed on models that are more fit (e.g., have higher fitness function values 544, fitness function values 544 that have changed significantly between two or more epochs, or both).

The extinction operation 556 uses a stagnation criterion to determine when a species should be omitted from a population used as the input set 520 for a subsequent epoch of the genetic algorithm 510. Generally, the extinction operation 556 is selectively performed on models that are satisfy a stagnation criteria, such as modes that have low fitness function values 544, fitness function values 544 that have changed little over several epochs, or both.

In accordance with the present disclosure, cooperative execution of the genetic algorithm 510 and the optimization trainer 560 is used arrive at a solution faster than would occur by using a genetic algorithm 510 alone or an optimization trainer 560 alone. Additionally, in some implementations, the genetic algorithm 510 and the optimization trainer 560 evaluate fitness using different data sets, with different measures of fitness, or both, which can improve fidelity of operation of the final model. To facilitate cooperative execution, a model (referred to herein as a trainable model 532 in FIG. 5) is occasionally sent from the genetic algorithm 510 to the optimization trainer 560 for training. In a particular implementation, the trainable model 532 is based on crossing over and/or mutating the fittest models (based on the fitness evaluation 540) of the input set 520. In such implementations, the trainable model 532 is not merely a selected model of the input set 520; rather, the trainable model 532 represents a potential advancement with respect to the fittest models of the input set 520.

The optimization trainer 560 uses a second portion 506 of the input data 502 to train the connection weights and biases of the trainable model 532, thereby generating a trained model 562. The optimization trainer 560 does not modify the architecture of the trainable model 532.

During optimization, the optimization trainer 560 provides a second portion 506 of the input data 502 to the trainable model 532 to generate output data. The optimization trainer 560 performs a second fitness evaluation 570 by comparing the data input to the trainable model 532 to the output data from the trainable model 532 to determine a second fitness function value 574 based on a second fitness function 572. The second fitness function 572 is the same as the first fitness function 542 in some implementations and is different from the first fitness function 542 in other implementations. In some implementations, the optimization trainer 560 or portions thereof is executed on a different device, processor, core, and/or thread than the genetic algorithm 510. In such implementations, the genetic algorithm 510 can continue executing additional epoch(s) while the connection weights of the trainable model 532 are being trained by the optimization trainer 560. When training is complete, the trained model 562 is input back into (a subsequent epoch of) the genetic algorithm 510, so that the positively reinforced "genetic traits" of the trained model 562 are available to be inherited by other models in the genetic algorithm 510.

In implementations in which the genetic algorithm 510 employs speciation, a species ID of each of the models may be set to a value corresponding to the species that the model has been clustered into. A species fitness may be determined for each of the species. The species fitness of a species may be a function of the fitness of one or more of the individual models in the species. As a simple illustrative example, the species fitness of a species may be the average of the fitness of the individual models in the species. As another example, the species fitness of a species may be equal to the fitness of the fittest or least fit individual model in the species. In alternative examples, other mathematical functions may be used to determine species fitness. The genetic algorithm 510 may maintain a data structure that tracks the fitness of each species across multiple epochs. Based on the species fitness, the genetic algorithm 510 may identify the "fittest" species, which may also be referred to as "elite species." Different numbers of elite species may be identified in different embodiments.

In a particular aspect, the genetic algorithm 510 uses species fitness to determine if a species has become stagnant and is therefore to become extinct. As an illustrative non-limiting example, the stagnation criterion of the extinction operation 556 may indicate that a species has become stagnant if the fitness of that species remains within a particular range (e.g., +/−5%) for a particular number (e.g., 5) of epochs. If a species satisfies a stagnation criterion, the species and all underlying models may be removed from subsequent epochs of the genetic algorithm 510.

In some implementations, the fittest models of each "elite species" may be identified. The fittest models overall may also be identified. An "overall elite" need not be an "elite member," e.g., may come from a non-elite species. Different numbers of "elite members" per species and "overall elites" may be identified in different embodiments."

The output set 530 of the epoch is generated based on the input set 520 and the evolutionary operation 550. In the illustrated example, the output set 530 includes the same number of models as the input set 520. In some implementations, the output set 530 includes each of the "overall elite" models and each of the "elite member" models. Propagating the "overall elite" and "elite member" models to the next epoch may preserve the "genetic traits" resulted in caused such models being assigned high fitness values.

The rest of the output set 530 may be filled out by random reproduction using the crossover operation 554 and/or the mutation operation 552. After the output set 530 is generated, the output set 530 may be provided as the input set 520 for the next epoch of the genetic algorithm 510.

After one or more epochs of the genetic algorithm 510 and one or more rounds of optimization by the optimization trainer 560, the system 500 selects a particular model or a set of models as the final model (e.g., a model that is executable to perform one or more of the model-based operations of FIGS. 1-4B). For example, the final model may be selected based on the fitness function values 544, 574. For example, a model or set of models having the highest fitness function value 544 or 574 may be selected as the final model. When multiple models are selected (e.g., an entire species is selected), an ensembler can be generated (e.g., based on heuristic rules or using the genetic algorithm 510) to aggregate the multiple models. In some implementations, the final model can be provided to the optimization trainer 560 for one or more rounds of optimization after the final model is selected. Subsequently, the final model can be output for use with respect to other data (e.g., real-time data).

Figure 6:
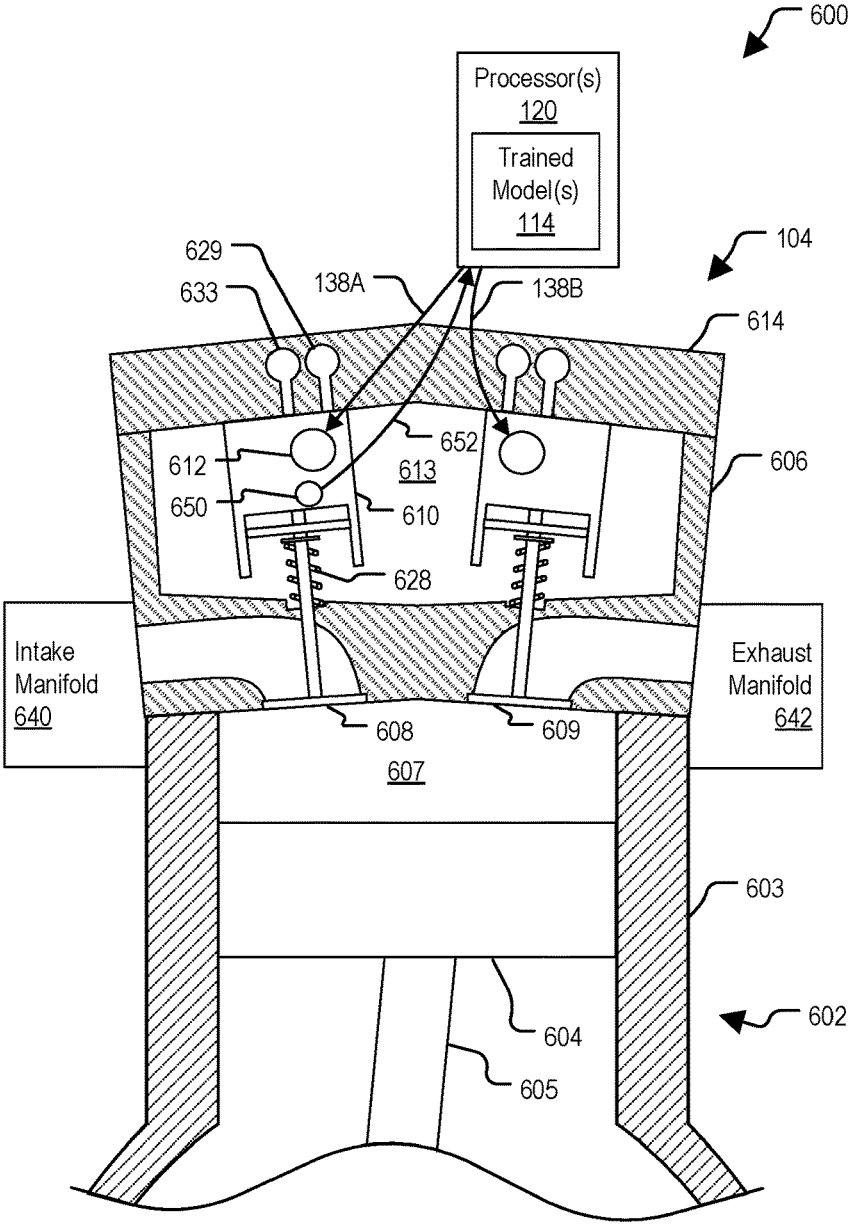
FIG. 6 is a diagram depicting an implementation of the valve of FIG. 1 in accordance with some examples of the present disclosure.

FIG. 6 illustrates a particular implementation 600 of components that may be used in the vehicle 102. The engine 104 includes a cylinder block 602 with at least one cylinder 603. Although a single cylinder 603 is depicted, it should be understood that in other implementations the engine 104 may include any number of additional cylinders that may operate substantially as described herein.

A piston 604 is axially displaceable in the cylinder 603 and coupled to a connection rod 605. The connection rod 605 is coupled to a crank shaft (not shown). A combustion chamber 607 is defined by an upper surface of the piston 604, walls of the cylinder 603, and a cylinder head 606. A mixture of fuel and air may enter the combustion chamber 607 from an intake manifold 640 via operation of a valve 608, and exhaust gas may exit the combustion chamber 607 to an exhaust manifold 642 via operation of a valve 609. In alternate embodiments, fuel and air may enter the combustion chamber 607 via separate valves that may be controlled using trained models in accordance with the present disclosure. The valves 608, 609, are coupled to valve actuators, such as a representative valve actuator 610, and may correspond to the valve 106 of FIG. 1. In a particular aspect, the intake manifold 640 corresponds to the reservoir 126 of FIG. 1, and the valve 608 corresponds to the valve 106 of FIG. 1. In another aspect, the exhaust manifold 642 corresponds to the reservoir 126 of FIG. 1, and the valve 609 corresponds to the valve 106 of FIG. 1.

In some implementations, the valve actuator 610 includes a pneumatic pressure fluid circuit with one or more inlet and outlet openings for pressure fluid (e.g., air or nitrogen gas, as non-limiting examples) to cause opening or closing of the valve 608 via motion of a valve stem, as described further below. In other implementations, however, the valve actuator 610 may be configured to use an electrical mechanism (e.g., a solenoid) or a mechanical mechanism (e.g., a motor) to cause the valve 608 to open or close. A return spring 628 may assist in causing the valve 608 to return from an open state to a closed state.

In some implementations, the valve actuator 610 includes a valve position sensor 650 configured to determine a position of the valve 608, such as by detecting a position or movement of a valve stem relative to the valve actuator 610, and to generate a valve position signal 652 that is provided to the one or more processors 120. For example, the valve position sensor 650 may correspond to one of the vehicle operation sensor(s) 118, and the valve position signal 652 may be included in the sensor data 124. Although the valve position sensor 650 is illustrated as a component of the valve actuator 610 that determines a position of the valve 608 via monitoring a position of the valve stem, in other implementations the valve position sensor 650 monitors valve position from another location, such as proximate to a valve head of the valve 608. Although a single valve position sensor 650 and valve position signal 652 are illustrated, in other implementations the engine 104 includes one or more additional valve position sensors. For example, each valve in the engine 104 may be coupled to a corresponding valve position sensor to provide position information for each of the valves for use by the one or more trained models 114.

The engine 104 comprises a cylinder head chamber 613 that forms part of a closed pressure fluid circuit. One or more valves, such as a representative valve 612 within the valve actuator 610, may be responsive to the control signal 138 to control operation of the pressure fluid circuit to control the valve 608. For example, the valve 612 may enable or disable pressurized fluid flow, such as to open or close fluid paths to a pressure fluid manifold 629, a hydraulic liquid manifold 633, or the cylinder head chamber 613.

During operation, the one or more processors 120 may process the one or more trained models 114, such as described with reference to FIGS. 1-4B, to generate the control signal 138 that includes a first control signal 138A and a second control signal 138B. The first control signal 138A is provided to the valve actuator 610 to control operation of one or more valves within the valve actuator 610, such as the representative valve 612, to operate the valve 608 to enable or prevent ingress of fuel and air into the combustion chamber 607. Similarly, the second control signal 138B is provided to another actuator to enable or prevent egress of exhaust to the exhaust manifold 642 by controlling the valve 609. It is be understood that the use of trained models to control valves is not merely limited to a binary decision of valve open vs. valve closed. Rather trained models may be used to determine, for each valve of an engine, lift, duration, timing, speed, etc. of the valve, as described with reference to FIG. 1. Thus, fine-grained control may be dynamically exercised over operation of the cylinder block 602, enabling improved engine performance under various conditions.

Although a single inlet valve and a single outlet valve are illustrated per cylinder, in other implementations any number of inlet valves and any number of outlet valves may be used in each cylinder. Sets of valves may be commonly controlled, such as two inlet valves controlled by a single valve actuator 610, or each valve may be individually controlled via independent actuators. In some implementations, the control signal 138 can adjust a number of active valves operating in the engine 104 by causing one or more inlet valves, one or more outlet valves, one or more cylinders/chambers, or a combination thereof, to be deactivated or activated. Other adjustments to operation of the engine 104 can be made via controlling one or more of the valves, such as by causing the engine 104 to transition between 2-stroke and 4-stroke operation.

The one or more trained models 114 may be processed by the one or more processors 120 at least partially based on valve positions (e.g., a set of valve position signals including the valve position signal 652). For example, the valve control model 116 may be configured to generate the control signal(s) 138 to actuate the valves responsive to the current positions of the valves. In some implementations, the valve control model 116 determines an engine startup cylinder firing sequence based on the detected valve positions. In some examples, the valve position signals provide feedback that are used by the one or more trained models 114 to detect abnormalities of valve operation, such as when a detected valve position does not match its designated position within a determined tolerance, which may be due to failure or impending failure of a valve actuator, pressurized fluid system, etc. To illustrate, the valve control model 116 may be configured to detect such abnormalities and to adjust operation of the engine 104 accordingly, such as by deactivating the valve or the cylinder associated with the valve, adjusting operation of the remaining valves to at least partially compensate for the resulting loss of power, adjusting one or more other aspects, or a combination thereof.

Figure 7:
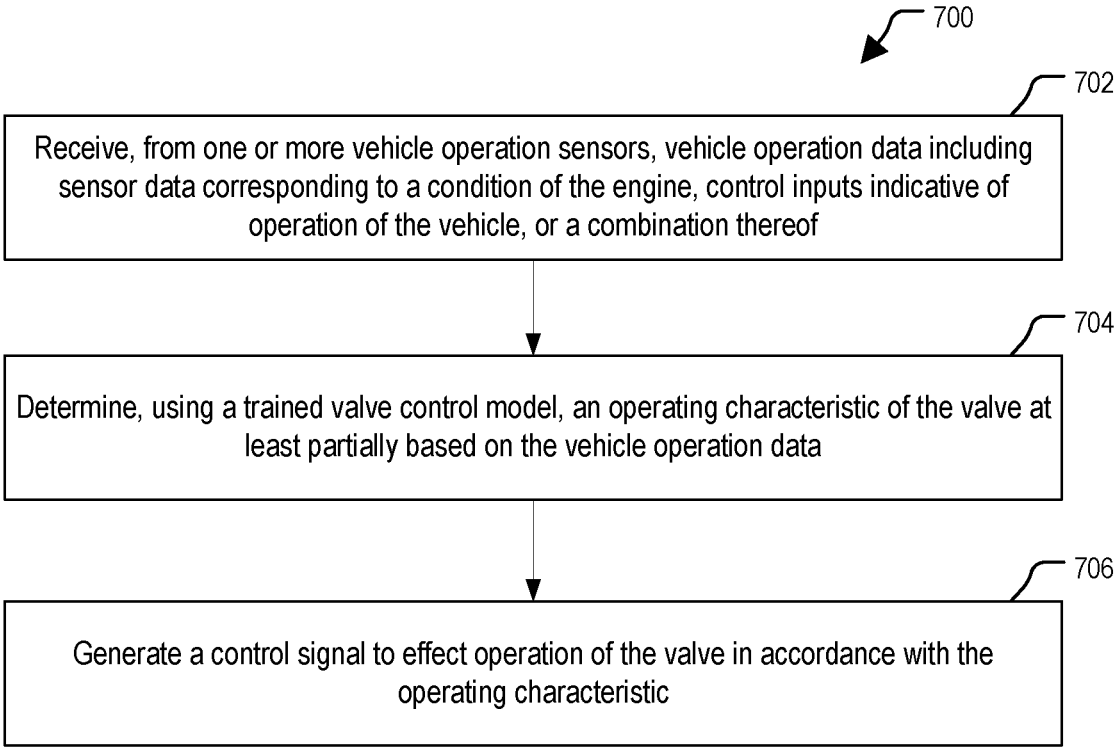
FIG. 7 is a flow chart of a method of controlling an electronically controllable valve of an engine of a vehicle in accordance with some examples of the present disclosure.

FIG. 7 depicts a flowchart of a method 700 of controlling an electronically controllable valve of an engine of a vehicle. In accordance with a particular implementation, the method 700 is performed by the vehicle 102, such as by the one or more processors 120 in the ECM 150 of FIG. 1.

The method 700 includes receiving, from one or more vehicle operation sensors, vehicle operation data including sensor data corresponding to a condition of the engine, control inputs indicative of operation of the vehicle, or a combination thereof, at block 702. For example, the one or more processors 120 receive the vehicle operation data 136 from sensors at the operator controls 128, from the vehicle operation sensor(s) 118, or a combination thereof.

The method 700 includes determining, using a trained valve control model, an operating characteristic of the valve at least partially based on the vehicle operation data, at block 704. For example, the one or more processors 120 determine the operating characteristic 134 of the valve 106 at least partially based on the valve control model 116.

The method 700 also includes generating a control signal to effect operation of the valve in accordance with the operating characteristic, at block 706. For example, the one or more processors 120 generate the control signal 138 to control operation of the valve 106 in accordance with the operating characteristic 134.

In some implementations, the method 700 also includes receiving, from one or more travel condition sensors, travel sensor data corresponding to a travel condition and determining, using a travel type model, a travel type based on the travel sensor data. For example, the travel sensor data 216 is received from the travel condition sensor(s) 210, and the travel type model 202 is used to determine the travel type 220. In such implementations, the operating characteristic 134 is determined further based on the travel type 220.

In some implementations, the method 700 also includes determining, using a trained operator type model, preference data corresponding to an operator of the vehicle. For example, the operator type model 204 is responsive to operator data 238 to generate the preference data 222. In such implementations, the operating characteristic 134 is determined further based on the preference data 222.

In some implementations, the method 700 also includes receiving a fleet control instruction and determining, using a fleet operation model, fleet operation data corresponding to a fleet control instruction that is received at the vehicle. For example, the fleet operation model 206 is responsive to the fleet control instruction 218 to generate the fleet operation data 224. In such implementations, the operating characteristic 134 is determined further based on the fleet operation data 224.

Figure 8:
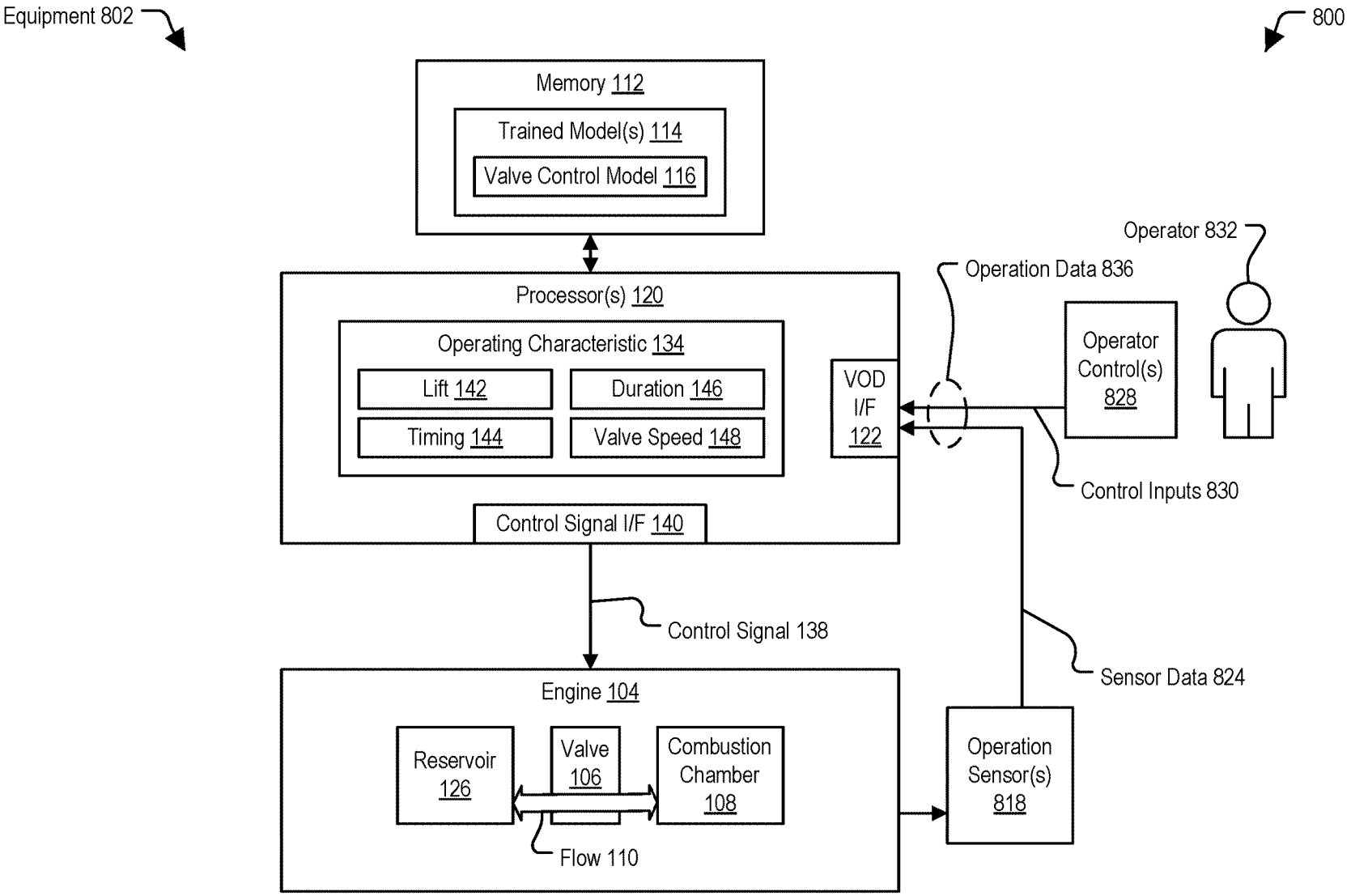
FIG. 8 illustrates a block diagram of a particular implementation of equipment that includes a valve control model to control operation of an electronically controllable valve of an engine in accordance with some examples of the present disclosure.

Although the preceding description describes implementations in which the engine 104 is in a vehicle, in other implementations the engine 104 is instead used in conjunction with other equipment, such as part of a power generator or other non-transportation equipment. FIG. 8 depicts a system 800 in which the memory 112, the one or more processors 120, and the engine 104 are components of equipment 802. The one or more processors 120 receive operation data 836 that includes sensor data 824 from one or more operation sensors 818 and control inputs 830 corresponding to manipulation of one or more operator controls 828 via an operator 832 of the equipment 802. Thus, it can be seen that the system 100 of FIG. 1 corresponds to a particular implementation of the system 800 in which the equipment 802 is a vehicle, although the system 800 is not limited to embodiments in which the equipment 802 is a vehicle.

Figure 9:
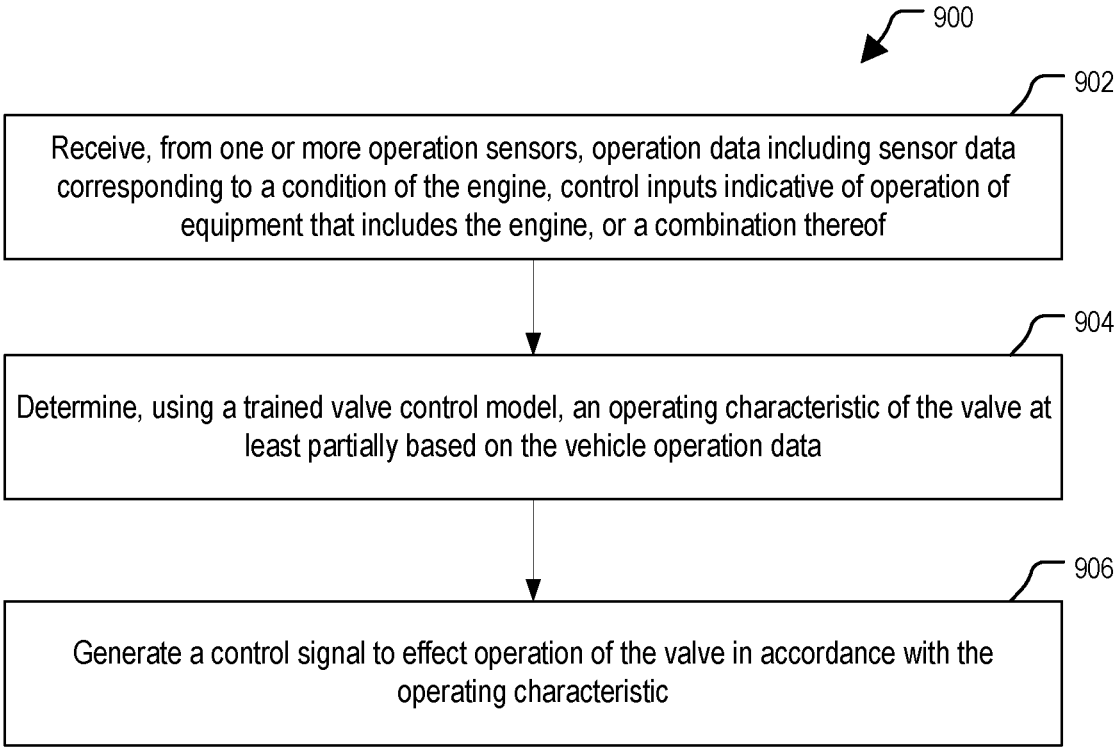
FIG. 9 is a flow chart of a method of controlling an electronically controllable valve of an engine in accordance with some examples of the present disclosure.

FIG. 9 depicts a flowchart of a method 900 of controlling an electronically controllable valve of an engine. In accordance with a particular implementation, the method 900 is performed by the one or more processors 120 of FIG. 8 implemented in non-transportation equipment.

The method 900 includes receiving, from one or more operation sensors, operation data including sensor data corresponding to a condition of the engine, control inputs indicative of operation of the equipment that includes the engine, or a combination thereof, at block 902. For example, the one or more processors 120 receive the operation data 836 from sensors at the operator controls 828, from the operation sensor(s) 818, or a combination thereof.

The method 900 includes determining, using a trained valve control model, an operating characteristic of the valve at least partially based on the operation data, at block 904. For example, the one or more processors 120 determine the operating characteristic 134 of the valve 106 at least partially based on the valve control model 116.

The method 900 also includes generating a control signal to effect operation of the valve in accordance with the operating characteristic, at block 906. For example, the one or more processors 120 generate the control signal 838 to control operation of the valve 106 in accordance with the operating characteristic 134.

The systems and methods illustrated herein may be described in terms of functional block components, screen shots, optional selections and various processing steps. It should be appreciated that such functional blocks may be realized by any number of hardware and/or software components configured to perform the specified functions. For example, the system may employ various integrated circuit components, e.g., memory elements, processing elements, logic elements, look-up tables, and the like, which may carry out a variety of functions under the control of one or more microprocessors or other control devices. Similarly, the software elements of the system may be implemented with any programming or scripting language such as C, C++, C#, Java, JavaScript, VBScript, Macromedia Cold Fusion, COBOL, Microsoft Active Server Pages, assembly, PERL, PHP, AWK, Python, Visual Basic, SQL Stored Procedures, PL/SQL, any UNIX shell script, and extensible markup language (XML) with the various algorithms being implemented with any combination of data structures, objects, processes, routines or other programming elements. Further, it should be noted that the system may employ any number of techniques for data transmission, signaling, data processing, network control, and the like.

The systems and methods of the present disclosure may be embodied as a customization of an existing system, an add-on product, a processing apparatus executing upgraded software, a standalone system, a distributed system, a method, a data processing system, a device for data processing, and/or a computer program product. Accordingly, any portion of the system or a module or a decision model may take the form of a processing apparatus executing code, an internet based (e.g., cloud computing) embodiment, an entirely hardware embodiment, or an embodiment combining aspects of the internet, software and hardware. Furthermore, the system may take the form of a computer program product on a computer-readable storage medium or device having computer-readable program code (e.g., instructions) embodied or stored in the storage medium or device. Any suitable computer-readable storage medium or device may be utilized, including hard disks, CD-ROM, optical storage devices, magnetic storage devices, and/or other storage media. As used herein, a "computer-readable storage medium" or "computer-readable storage device" is not a signal.

In accordance with one or more disclosed aspects, an apparatus for controlling an electronically controllable valve of an engine of a vehicle includes means for receiving vehicle operation data including sensor data corresponding to a condition of the engine, control inputs indicative of operation of the vehicle, or a combination thereof. For example, in a particular implementation the means for receiving vehicle operation data includes the vehicle operation data interface 122, the one or more processors 120, the electronic control module 150, one or more other circuits or devices to receive vehicle operation data, or any combination thereof.

The apparatus includes means for determining, using a trained valve control model, an operating characteristic of the valve at least partially based on the vehicle operation data. For example, in a particular implementation the means for determining the operating characteristic of the valve includes the one or more processors 120, the memory 112, the electronic control module 150, one or more other circuits or devices to determine, using a trained valve control model, an operating characteristic of the valve, or any combination thereof.

The apparatus also includes means for generating a control signal to effect operation of the valve in accordance with the operating characteristic. For example, in a particular implementation the means for generating the control signal includes the control signal interface 140, the one or more processors 120, the electronic control module 150, one or more other circuits or devices to generate the control signal, or any combination thereof.

In accordance with one or more disclosed aspects, an apparatus for controlling an electronically controllable valve of an engine includes means for receiving operation data including sensor data corresponding to a condition of the engine, control inputs indicative of operation of equipment that includes the engine, or a combination thereof. For example, in a particular implementation the means for receiving operation data includes the vehicle operation data interface 122, the one or more processors 120, the electronic control module 150, one or more other circuits or devices to receive operation data, or any combination thereof.

The apparatus includes means for determining, using a trained valve control model, an operating characteristic of the valve at least partially based on the operation data. For example, in a particular implementation the means for determining the operating characteristic of the valve includes the one or more processors 120, the memory 112, the electronic control module 150, one or more other circuits or devices to determine, using a trained valve control model, an operating characteristic of the valve, or any combination thereof.

The apparatus also includes means for generating a control signal to effect operation of the valve in accordance with the operating characteristic. For example, in a particular implementation the means for generating the control signal includes the control signal interface 140, the one or more processors 120, the electronic control module 150, one or more other circuits or devices to generate the control signal, or any combination thereof.

Systems and methods may be described herein with reference to screen shots, block diagrams and flowchart illustrations of methods, apparatuses (e.g., systems), and computer media according to various aspects. It will be understood that each functional block of a block diagrams and flowchart illustration, and combinations of functional blocks in block diagrams and flowchart illustrations, respectively, can be implemented by computer program instructions.

Computer program instructions may be loaded onto a computer or other programmable data processing apparatus to produce a machine, such that the instructions that execute on the computer or other programmable data processing apparatus create means for implementing the functions specified in the flowchart block or blocks. These computer program instructions may also be stored in a computer-readable memory or device that can direct a computer or other programmable data processing apparatus to function in a particular manner, such that the instructions stored in the computer-readable memory produce an article of manufacture including instruction means which implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware-based computer systems which perform the specified functions or steps, or suitable combinations of special purpose hardware and computer instructions.

Although the disclosure may include a method, it is contemplated that it may be embodied as computer program instructions on a tangible computer-readable medium, such as a magnetic or optical memory or a magnetic or optical disk/disc. All structural, chemical, and functional equivalents to the elements of the above-described exemplary embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Changes and modifications may be made to the disclosed embodiments without departing from the scope of the present disclosure. These and other changes or modifications are intended to be included within the scope of the present disclosure, as expressed in the following claims.

What is claimed is:

1. A vehicle comprising:

an engine comprising:

a valve coupled to a combustion chamber and configured to control flow into the combustion chamber, out of the combustion chamber, or both; and an electronically controllable valve actuator coupled to the valve via a valve stem, the valve actuator including at least one of a pneumatic pressure fluid circuit, a solenoid, or a motor configured to control opening or closing of the valve via movement of the valve stem responsive to a control signal;

a memory configured to store one or more trained models, the one or more trained models including a valve control model and a travel type model that is distinct from the valve control model;

one or more vehicle operation sensors configured to generate vehicle operation data, the vehicle operation data including sensor data corresponding to a condition of the engine, control inputs indicative of operation of the vehicle, or a combination thereof; and one or more processors configured to:

determine, using the travel type model, a travel type selected from among a plurality of travel types based on travel sensor data;

input the selected travel type and the vehicle operation data to the valve control model;

determine, using the valve control model, an operating characteristic of the valve; and generate the control signal to effect operation of the valve in accordance with the operating characteristic.

2. The vehicle of claim 1, wherein the operating characteristic corresponds to one or more of a displacement of the valve, a timing of the valve, a duration of an open state or a closed state of the valve, or a speed of the valve.

3. The vehicle of claim 1, further comprising one or more travel condition sensors configured to generate the travel sensor data corresponding to a travel condition.

4. The vehicle of claim 3, wherein:

the plurality of travel types includes at least one of: turning, straight travel, increasing speed, decreasing speed, stable speed, increasing elevation, decreasing elevation, or motionless.

5. The vehicle of claim 1, wherein the one or more trained models further include an operator type model, and wherein the one or more processors are further configured to:

determine, using the operator type model, preference data corresponding to an operator of the vehicle; and determine the operating characteristic further based on the preference data.

6. The vehicle of claim 5, wherein the operator type model includes, for one or more operator types, operator preference information regarding the plurality of travel types, and wherein the operator preference information indicates a preference for one or more categories corresponding to at least one of cruise, sport, comfort, acceleration, economy, or speed.

7. The vehicle of claim 1, wherein the one or more trained models further include a fleet operation model, and wherein the one or more processors are further configured to:

determine, using the fleet operation model, fleet operation data corresponding to a fleet control instruction that is received at the vehicle; and determine the operating characteristic further based on the fleet operation data.

8. The vehicle of claim 7, wherein the fleet control instruction corresponds to an instruction from a governmental or regulatory entity.

9. The vehicle of claim 7, wherein the fleet control instruction corresponds to an instruction from a manufacturer or corporate owner of the vehicle.

10. The vehicle of claim 1, wherein the vehicle corresponds to at least one of an aircraft, a watercraft, or a land vehicle.

11. An apparatus for controlling an engine of a vehicle, the apparatus comprising:

a memory configured to store one or more trained models, the one or more trained models including a valve control model; and one or more processors configured to:

receive operator data that indicates an operator of the vehicle;

determine, using a trained operator type model, operator preference data based on the operator data;

receive vehicle operation data that includes sensor data corresponding to a condition of the engine, control inputs indicative of operation of the vehicle, or a combination thereof;

input the operator preference data and the vehicle operation data to a trained valve control model;

determine, using the trained valve control model, an operating characteristic of a valve of the engine, the valve coupled to a combustion chamber and configured to control flow into the combustion chamber, out of the combustion chamber, or both; and generate a control signal to cause an electronically controllable valve actuator to use at least one of a pneumatic pressure fluid circuit, a solenoid, or a motor to control opening or closing of the valve via movement of a valve stem to effect operation of the valve in accordance with the operating characteristic.

12. The apparatus of claim 11, wherein the one or more processors are further configured to:

receive, from one or more travel condition sensors, travel sensor data corresponding to a travel condition; and determine, using a travel type model, a travel type based on the travel sensor data, wherein the operating characteristic is determined further based on the travel type.

13. The apparatus of claim 11, wherein the operator data includes biometric data.

14. The apparatus of claim 11, wherein the one or more processors are further configured to:

determine, using a fleet operation model, fleet operation data corresponding to a fleet control instruction that is received at the vehicle, wherein the operating characteristic is determined further based on the fleet operation data.

15. A method of controlling a cylinder intake valve or a cylinder exhaust valve of an engine of a vehicle, the method comprising:

receiving, from one or more vehicle operation sensors, vehicle operation data including sensor data corresponding to a condition of the engine, control inputs indicative of operation of the vehicle, or a combination thereof;

receiving, from one or more travel condition sensors, travel sensor data corresponding to a travel condition;

determining, using a trained travel type model, a travel type selected from among a plurality of travel types based on the travel sensor data;

determining, using a trained valve control model that is distinct from the trained travel type model, an operating characteristic of the cylinder intake valve or the cylinder exhaust valve based on the vehicle operation data and the selected travel type; and generating a control signal to cause an electronically controllable valve actuator to use at least one of a pneumatic pressure fluid circuit, a solenoid, or a motor to control opening or closing of the cylinder intake valve or the cylinder exhaust valve to effect operation of the cylinder intake valve or the cylinder exhaust valve in accordance with the operating characteristic.

16. The method of claim 15, further comprising determining, using a trained operator type model, preference data corresponding to an operator of the vehicle, and wherein the operating characteristic is determined further based on the preference data.

17. The method of claim 16, wherein the trained operator type model determines the preference data based on operator data and further based on the selected travel type.

18. The method of claim 15, further comprising:

determining, using a fleet operation model, fleet operation data corresponding to a fleet control instruction that is received at the vehicle, wherein the operating characteristic is determined further based on the fleet operation data.

19. A computer-readable storage device storing instructions that, when executed by one or more processors, cause the one or more processors to:

receive vehicle operation data that includes sensor data corresponding to a condition of an engine of a vehicle, control inputs indicative of operation of the vehicle, or a combination thereof;

receive, from one or more travel condition sensors, travel sensor data corresponding to a travel condition;

determine, using a trained travel type model, a travel type based on the travel sensor data;

determine, based on the vehicle operation data and the travel type and using a trained valve control model that is distinct from the trained travel type model, an operating characteristic of a valve that is coupled to a combustion chamber and configured to control flow into the combustion chamber, out of the combustion chamber, or both; and generate a control signal to cause an electronically controllable valve actuator to use at least one of a pneumatic pressure fluid circuit, a solenoid, or a motor to control opening or closing of the valve via movement of a valve stem to effect operation of the valve in accordance with the operating characteristic.

20. An apparatus for controlling a cylinder intake or exhaust valve of an engine of a vehicle, the apparatus comprising:

means for receiving vehicle operation data including sensor data corresponding to a condition of the engine, control inputs indicative of operation of the vehicle, or a combination thereof;

means for determining, using a trained travel type model, a travel type based on travel sensor data that is received from one or more travel condition sensors and that corresponds to a travel condition;

means for determining, using a trained valve control model that is distinct from the trained travel type model, an operating characteristic of the valve at least partially based on the vehicle operation data and the travel type, the valve corresponding to a cylinder intake valve or a cylinder exhaust valve; and means for generating a control signal to cause an electronically controllable valve actuator to use at least one of a pneumatic pressure fluid circuit, a solenoid, or a motor to control opening or closing of the valve to effect operation of the valve in accordance with the operating characteristic.

21. A method of controlling a valve of an engine, the valve coupled to a combustion chamber of the engine and configured to control flow into the combustion chamber, out of the combustion chamber, or both, the method comprising:

receiving, from one or more operation sensors, operation data including sensor data corresponding to a condition of the engine, control inputs indicative of operation of equipment that includes the engine, or a combination thereof;

determining, using a trained operator type model, operator preference data based on received operator data;

inputting the operator preference data and the operation data to a trained valve control model that is distinct from the trained operator type model;

determining, using the trained valve control model, an operating characteristic of the valve; and generating a control signal to effect operation of the valve in accordance with the operating characteristic, the control signal configured to cause an electronically controllable valve actuator to operate at least one of a pneumatic pressure fluid circuit, a solenoid, or a motor to control opening or closing of the valve via movement of a valve stem.

22. An apparatus for controlling an engine, the apparatus comprising:

a memory configured to store one or more trained models, the one or more trained models including a valve control model; and one or more processors configured to:

receive operation data that includes sensor data corresponding to a condition of the engine, control inputs indicative of operation of equipment that includes the engine, or a combination thereof;

determine, using a trained operator type model, operator preference data based on received operator data;

input the operator preference data and the operation data to a trained valve control model that is distinct from the trained operator type model;

determine, using the trained valve control model, an operating characteristic of a cylinder intake or exhaust valve; and generate a control signal to cause an electronically controllable valve actuator, including at least one of a pneumatic pressure fluid circuit, a solenoid, or a motor coupled to the valve via a valve stem, to control opening or closing of the valve via movement of the valve stem responsive to the control signal to effect operation of the valve in accordance with the operating characteristic.

* * * * *